US011667858B2

(12) United States Patent
Eller et al.

(10) Patent No.: US 11,667,858 B2
(45) **Date of Patent: *Jun. 6, 2023**

(54) LOW SULFUR FUEL OIL BLENDS FOR STABILITY ENHANCEMENT AND ASSOCIATED METHODS

(71) Applicant: MARATHON PETROLEUM COMPANY LP, Findlay, OH (US)

(72) Inventors: Richard L. Eller, Findlay, OH (US); Peg Broughton, Findlay, OH (US); V. Elijah Mullins, Findlay, OH (US); John R. Weber, Findlay, OH (US); Jeffrey A. Sexton, Findlay, OH (US)

(73) Assignee: MARATHON PETROLEUM COMPANY LP, Findlay, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/727,094

(22) Filed: Apr. 22, 2022

(65) Prior Publication Data

US 2022/0251462 A1 Aug. 11, 2022

Related U.S. Application Data

(63) Continuation of application No. 17/249,081, filed on Feb. 19, 2021, now Pat. No. 11,352,578.

(Continued)

(51) Int. Cl.
*C10L 1/04* (2006.01)
*C10L 10/00* (2006.01)

(Continued)

(52) U.S. Cl.
CPC ..... *C10L 1/04* (2013.01); *C10G 11/18* (2013.01); *C10G 69/04* (2013.01); *C10L 1/06* (2013.01);

(Continued)

(58) Field of Classification Search
CPC ..... A61K 2300/00; A61K 38/04; A61K 38/1729; A61K 38/26; A61K 45/06;

(Continued)

(56) References Cited

U.S. PATENT DOCUMENTS 5,997,723 A 12/1999 Wiehe et al.
6,454,935 B1 9/2002 Lesieur et al.

(Continued)

FOREIGN PATENT DOCUMENTS

CA 2949201 11/2015
CA 3009808 7/2017

(Continued)

OTHER PUBLICATIONS

Lerh, Jeslyn et al., Feature: IMO 2020 draws more participants into Singapore's bunkering pool, Oil | Shipping, Sep. 3, 2019, Singapore, https://www.spglobal.com/platts/en/market-insights/latest-news/oil/090319-feature-imo-2020-draws-more-participants-into-singapores-bunkering-pool.

(Continued)

*Primary Examiner* — Ellen M McAvoy
*Assistant Examiner* — Chantel L Graham
(74) *Attorney, Agent, or Firm* — Womble Bond Dickinson (US) LLP

(57) ABSTRACT

Fuel oil compositions, and methods for blending such fuel oil compositions, to enhance initial compatibility and longer term stability when such fuel oil compositions are blended to meet IMO 2020 low sulfur fuel oil requirements (ISO 8217). In one or more embodiments, asphaltenic resid base stocks are blended with high aromatic slurry oil to facilitate initial compatibility such that low sulfur cutter stocks, e.g., vacuum gas oil and/or cycle oil, may be further blended therein to cut sulfur content while maintaining longer term stability. These fuel oil compositions are economically (Continued)

advantageous when used as marine low sulfur fuel oils because greater concentrations of high viscosity resids are present in the final blend.

26 Claims, 7 Drawing Sheets

Related U.S. Application Data

(60) Provisional application No. 63/199,188, filed on Dec. 11, 2020, provisional application No. 62/978,798, filed on Feb. 19, 2020.

(51) Int. Cl.
*C10L 1/06* (2006.01)
*C10G 69/04* (2006.01)
*C10L 1/08* (2006.01)
*C10G 11/18* (2006.01)

(52) U.S. Cl.
CPC ..... *C10L 1/08* (2013.01); *C10L 10/00* (2013.01); *C10G 2300/107* (2013.01); *C10G 2300/1077* (2013.01); *C10G 2300/202* (2013.01); *C10G 2300/205* (2013.01); *C10G 2300/206* (2013.01); *C10G 2300/207* (2013.01); *C10G 2300/302* (2013.01); *C10G 2300/304* (2013.01); *C10G 2300/308* (2013.01); *C10G 2400/04* (2013.01); *C10L 2200/0263* (2013.01); *C10L 2200/0438* (2013.01); *C10L 2200/0446* (2013.01); *C10L 2200/0461* (2013.01); *C10L 2230/14* (2013.01); *C10L 2270/026* (2013.01); *C10L 2290/24* (2013.01); *C10L 2290/46* (2013.01); *C10L 2290/543* (2013.01); *C10L 2290/547* (2013.01)

(58) Field of Classification Search
CPC . A61K 9/0053; A61P 1/16; A61P 1/18; A61P 3/00; C10G 11/18; C10G 2300/107; C10G 2300/1077; C10G 2300/202; C10G 2300/205; C10G 2300/206; C10G 2300/207; C10G 2300/302; C10G 2300/304; C10G 2300/308; C10G 2400/04; C10G 69/04; C10L 1/04; C10L 1/06; C10L 1/08; C10L 10/00; C10L 2200/0263; C10L 2200/0438; C10L 2200/0446; C10L 2200/0461; C10L 2230/14; C10L 2270/026; C10L 2290/24; C10L 2290/46; C10L 2290/543; C10L 2290/547
See application file for complete search history.

(56) References Cited

U.S. PATENT DOCUMENTS 7,228,250 B2 6/2007 Naiman et al.
7,244,350 B2 7/2007 Kar et al.
8,029,662 B2 10/2011 Varma et al.
8,038,774 B2 10/2011 Peng
8,193,401 B2 6/2012 McGehee et al.
8,524,180 B2 9/2013 Canari et al.
8,916,041 B2 12/2014 Van Den Berg et al.
8,987,537 B1 * 3/2015 Droubi ..... C10L 10/02 208/15
8,999,011 B2 4/2015 Stern et al.
9,057,035 B1 6/2015 Kraus et al.
9,109,176 B2 8/2015 Stern et al.
9,216,376 B2 12/2015 Liu et al.
9,272,241 B2 3/2016 Königsson
9,289,715 B2 3/2016 Høy-Petersen et al.
9,393,520 B2 7/2016 Gomez
9,410,102 B2 8/2016 Eaton et al.
9,458,396 B2 10/2016 Weiss et al.
9,487,718 B2 11/2016 Kraus et al.
9,499,758 B2 11/2016 Droubi et al.
9,624,448 B2 4/2017 Joo et al.
9,650,580 B2 5/2017 Merdrignac et al.
9,757,686 B2 9/2017 Peng
9,803,152 B2 10/2017 Kar et al.
9,834,731 B2 12/2017 Weiss et al.
9,840,674 B2 12/2017 Weiss et al.
9,873,080 B2 1/2018 Richardson
9,878,300 B2 1/2018 Norling
9,895,649 B2 2/2018 Brown et al.
9,896,630 B2 2/2018 Weiss et al.
9,914,094 B2 3/2018 Jenkins et al.
9,920,270 B2 3/2018 Robinson et al.
10,047,299 B2 8/2018 Rubin-Pitel et al.
10,099,175 B2 10/2018 Takahashi et al.
10,150,078 B2 12/2018 Komatsu et al.
10,266,779 B2 4/2019 Weiss et al.
10,308,884 B2 6/2019 Klussman
10,316,263 B2 6/2019 Rubin-Pitel et al.
10,443,006 B1 10/2019 Fruchey et al.
10,457,881 B2 10/2019 Droubi et al.
10,494,579 B2 12/2019 Wrigley et al.
10,501,699 B2 12/2019 Robinson et al.
10,533,141 B2 1/2020 Moore et al.
10,563,132 B2 2/2020 Moore et al.
10,563,133 B2 2/2020 Moore et al.
10,577,551 B2 3/2020 Kraus et al.
10,584,287 B2 3/2020 Klussman et al.
10,604,709 B2 3/2020 Moore et al.
10,655,074 B2 5/2020 Moore et al.
10,836,966 B2 11/2020 Moore et al.
10,876,053 B2 12/2020 Klussman et al.
10,954,456 B2 3/2021 Moore et al.
10,961,468 B2 3/2021 Moore et al.
11,021,662 B2 6/2021 Moore et al.
11,124,714 B2 9/2021 Eller et al.
11,136,513 B2 10/2021 Moore et al.
11,203,722 B2 12/2021 Moore et al.
2004/0040201 A1 3/2004 Roos et al.
2004/0121472 A1 6/2004 Nemana et al.
2011/0277377 A1 11/2011 Novak et al.
2013/0014431 A1 1/2013 Jin et al.
2013/0109895 A1 5/2013 Novak et al.
2014/0299515 A1 10/2014 Weiss et al.
2014/0332444 A1 11/2014 Weiss et al.
2015/0240174 A1 8/2015 Bru et al.
2015/0337225 A1 11/2015 Droubi et al.
2015/0337226 A1 11/2015 Tardif et al.
2015/0353851 A1 12/2015 Buchanan
2016/0122662 A1 5/2016 Weiss et al.
2016/0122666 A1 5/2016 Weiss et al.
2016/0160139 A1 6/2016 Dawe et al.
2016/0312130 A1 10/2016 Majcher et al.
2017/0009163 A1 1/2017 Kraus et al.
2017/0183575 A1 6/2017 Rubin-Pitel
2017/0233670 A1 8/2017 Feustel et al.
2018/0037308 A1 2/2018 Lee et al.
2018/0134974 A1 5/2018 Cloupet et al.
2018/0163144 A1 6/2018 Weiss et al.
2018/0230389 A1 8/2018 Moore et al.
2018/0355263 A1 12/2018 Moore et al.
2018/0361312 A1 12/2018 Dutra e Mello et al.
2019/0002772 A1 1/2019 Moore et al.
2019/0010405 A1 1/2019 Moore et al.
2019/0010408 A1 1/2019 Moore et al.
2019/0016980 A1 1/2019 Kar et al.
2019/0093026 A1 3/2019 Wohaibi et al.
2019/0099706 A1 4/2019 Sampath
2019/0127651 A1 5/2019 Kar et al.
2019/0128160 A1 5/2019 Peng
2019/0136144 A1 5/2019 Wohaibi et al.
2019/0153340 A1 5/2019 Weiss et al.
2019/0153942 A1 5/2019 Wohaibi et al.
2019/0185772 A1 6/2019 Berkhous et al.

(56) References Cited

U.S. PATENT DOCUMENTS

| | | | |
|---|---|---|---|
| 2019/0201841 | A1 | 7/2019 | McClelland |
| 2019/0203130 | A1 | 7/2019 | Mukherjee |
| 2019/0233741 | A1 | 8/2019 | Moore et al. |
| 2019/0338205 | A1 | 11/2019 | Ackerson et al. |
| 2019/0382668 | A1 | 12/2019 | Klussman et al. |
| 2020/0095509 | A1 | 3/2020 | Moore et al. |
| 2020/0123458 | A1 | 4/2020 | Moore et al. |
| 2020/0199462 | A1 | 6/2020 | Klussman et al. |
| 2020/0385644 | A1 | 12/2020 | Rogel et al. |
| 2021/0238487 | A1 | 8/2021 | Moore et al. |
| 2021/0253964 | A1 | 8/2021 | Eller et al. |
| 2021/0253965 | A1 | 8/2021 | Woodchick et al. |
| 2021/0261874 | A1 | 8/2021 | Eller et al. |
| 2021/0284919 | A1 | 9/2021 | Moore et al. |
| 2021/0292661 | A1 | 9/2021 | Klussman et al. |
| 2021/0403819 | A1 | 12/2021 | Moore et al. |

FOREIGN PATENT DOCUMENTS

| | | |
|---|---|---|
| CN | 201940168 | 8/2011 |
| CN | 102120138 | 12/2012 |
| CN | 203816490 | 9/2014 |
| CN | 104353357 | 2/2015 |
| CN | 204170623 | 2/2015 |
| CN | 103331093 | 4/2015 |
| CN | 204253221 | 4/2015 |
| CN | 204265565 | 4/2015 |
| CN | 105148728 | 12/2015 |
| CN | 103933845 | 1/2016 |
| CN | 105289241 | 2/2016 |
| CN | 105536486 | 5/2016 |
| CN | 105804900 | 7/2016 |
| CN | 103573430 | 8/2016 |
| CN | 104326604 | 11/2016 |
| CN | 104358627 | 11/2016 |
| CN | 106237802 | 12/2016 |
| CN | 205779365 | 12/2016 |
| CN | 105778987 | 8/2017 |
| CN | 108179022 | 6/2018 |
| CN | 108704478 | 10/2018 |
| CN | 14t109126458 | 1/2019 |
| CN | 109423345 | 3/2019 |
| CN | 109499365 | 3/2019 |
| CN | 109705939 | 5/2019 |
| CN | 109722303 | 5/2019 |
| CN | 110129103 | 8/2019 |
| CN | 110229686 | 9/2019 |
| CN | 209451617 | 10/2019 |
| DE | 102010017563 | 12/2011 |
| EP | 1600491 | 11/2005 |
| EP | 2955345 | 12/2015 |
| EP | 3130773 | 2/2017 |
| EP | 3139009 | 3/2017 |
| EP | 3239483 | 11/2017 |
| EP | 3085910 | 8/2018 |
| EP | 3355056 | 8/2018 |
| EP | 2998529 | 2/2019 |
| EP | 3441442 | 2/2019 |
| FR | 3004722 | 3/2016 |
| FR | 3027909 | 5/2016 |
| FR | 3067036 | 12/2018 |
| FR | 3067037 | 12/2018 |
| FR | 3072684 | 4/2019 |
| FR | 3075808 | 6/2019 |
| JP | 3160405 | 6/2010 |
| JP | 2015059220 | 3/2015 |
| JP | 2019014275 | 1/2019 |
| KR | 101751923 | 7/2017 |
| KR | 101823897 | 3/2018 |
| KR | 20180095303 | 8/2018 |
| KR | 20190004474 | 1/2019 |
| KR | 20190004475 | 1/2019 |
| RU | 2673558 | 11/2018 |
| RU | 2700705 | 9/2019 |
| WO | 2008088294 | 7/2008 |
| WO | 2012026302 | 3/2012 |
| WO | 2012089776 | 7/2012 |
| WO | 2012108584 | 8/2012 |
| WO | 2014096703 | 6/2014 |
| WO | 2014096704 | 6/2014 |
| WO | 422014096704 | 6/2014 |
| WO | 2014191004 | 7/2014 |
| WO | 2014177424 | 11/2014 |
| WO | 2014202815 | 12/2014 |
| WO | 2018073018 | 4/2016 |
| WO | 2016167708 | 10/2016 |
| WO | 2017067088 | 4/2017 |
| WO | 2018122274 | 7/2018 |
| WO | 20180148675 | 8/2018 |
| WO | 20180148681 | 8/2018 |
| WO | 2018231105 | 12/2018 |
| WO | 2019053323 | 3/2019 |
| WO | 2019104243 | 5/2019 |
| WO | 2019155183 | 8/2019 |
| WO | 2019178701 | 9/2019 |

OTHER PUBLICATIONS

Vivek Rathor et al., Assessment of crude oil blends, refiner's assessment of the compatibility of opportunity crudes in blends aims to avoid the processing problems introduced by lower-quality feedstocks, www.digitalrefining.com/article/1000381, 2011.

International Standard, ISO 8217, Petroleum products—Fuels (class F)—Specifications of marine fuels, Sixth Edition, 2017.

International Standard, ISO 10307-1, Petroleum products—Total sediment in residual fuel oils—, Part 1: Determination by hot filtration, Second Edition, 2009.

International Standard, ISO 10307-2, Petroleum products—Total sediment in residual fuel oils—Part 2: Determination using standard procedures for ageing, Second Edition, 2009.

* cited by examiner

| Blend | #1 | #2 | #3 | #4 | #5 | #6 | #7 | #8 | #9 | #10 |
|---|---|---|---|---|---|---|---|---|---|---|
| Component 1 (DCO%) | 19.1% | 20.9% | 5.3% | 27.9% | 15.0% | 17.5% | 52.7% | 29.5% | 29.2% | 32.5% |
| Component 2 (HSFO%) | 24.3% | 14.4% | 26.0% | 24.5% | 37.2% | 24.0% | 16.3% | 24.0% | 50.6% | 15.4% |
| Component 3 (LSVGO%) | 56.7% | 63.4% | 68.4% | 45.8% | 46.8% | 57.3% | 27.6% | 44.6% | 18.4% | 50.0% |
| Component 4 (LCO%) | 0.0% | 1.3% | 0.3% | 1.8% | 1.0% | 1.1% | 3.4% | 1.9% | 1.9% | 2.1% |

LOW SULFUR FUEL OIL BLENDS FOR STABILITY ENHANCEMENT AND ASSOCIATED METHODS

CROSS-REFERENCE TO RELATED APPLICATIONS

The present application is a continuation of U.S. Non-Provisional application Ser. No. 17/249,081, filed Feb. 19, 2021, titled "Low Sulfur Fuel Oil Blends for Stability Enhancement and Associated Methods," which claims priority to and the benefit of U.S. Provisional Application No. 62/978,798, filed Feb. 19, 2020, titled "Low Sulfur Fuel Oil Blending for Stability Enhancement and Associated Methods," and U.S. Provisional Application No. 63/199,188, filed Dec. 11, 2020, titled "Low Sulfur Fuel Oil Blending for Paraffinic Resid Stability and Associated Methods," the disclosures of which are incorporated herein by reference in their entirety.

FIELD OF THE DISCLOSURE

Embodiments herein generally relate to fuel oil compositions. More specifically, one or more embodiments relate to low sulfur marine bunker fuel oil compositions, and methods of blending such compositions.

BACKGROUND

The International Marine Organization (IMO) operates as an agency of the United Nations (originally formed in 1948 as the Inter-Governmental Maritime Consultative Organization) and sets global standards for the safety and security of international shipping as well as the prevention of environmental pollution by such shipping. The promotion of sustainable shipping and maritime development has been a major goal of IMO in recent years. To that end, the Marine Environment Protection Committee, the working arm of IMO charged with addressing environmental issues, has adopted more stringent worldwide marine sulfur standards for all maritime transport. These increased standards took effect in 2020 and are set forth in ISO 8217 Petroleum Products—Fuels (Class F)—Specifications of Marine Fuels, published by the International Organization for Standardization ("IMO 2020"). The United States has been a member of IMO since 1950 and has since that time enforced the maritime compliance of all IMO regulations.

Maritime transportation operates as a critical part of the global economy, responsible for more than 80% of global trade by volume. At least 10% of such trade originates from U.S. ports. This global shipping volume comes with a large global oil demand, which has been estimated by the International Energy Agency to be approximately 4.3 million barrels per day, which is equivalent to about 4% of the global energy demand. The IMO 2020 standards implement a requirement to reduce sulfur in traditional marine fuel—high sulfur fuel oils—to be less than 0.5% by weight (less than 5000 wppm). Thus, the effect of the IMO 2020 standards significantly impacts scope and volume.

Compliance with the IMO 2020 regulations resides with vessel owners and operators, which employ marine fuels otherwise known as bunker fuels for powering maritime vessels globally. Generally, there exists three options for such vessel owners and operators to comply with the IMO 2020 regulations: First, they can use a marine bunker fuel oil having less than 0.5% sulfur by weight. Second, they can continue to use high sulfur marine fuel oils and install a scrubber on the maritime vessel to remove sulfur from the combustion gases or emissions. Or, thirdly, they can switch to alternative fuels, such as natural gas, with low sulfur content that alternatively meet the low sulfur requirement.

U.S refineries account for approximately 20% of global refining capability. Therefore, the need to produce low sulfur fuel oils for maritime use with sulfur contents less than 0.5% by weight has been and will continue to be a challenge to U.S refining operations. The dilution of high sulfur fuel oils with low sulfur distillates to meet the low sulfur, viscosity, and the other fuel specifications of IMO 2020, has been a strategy of many refiners. Asphaltene precipitation, however, continues to be problematic.

In an attempt to prevent asphaltene precipitation upon mixing high sulfur fuel oils with low sulfur distillates, refiners have increasingly turned to proprietary additives to facilitate maintaining asphaltenes in solution. Such stop gap measures are expensive and tenuous at best when solving the larger problem of fuel compatibility and/or stability. What is needed therefore is a fuel oil blend that meets the specifications of IMO 2020 (see ISO 8217), including its low sulfur requirement, while achieving initial compatibility and longer term stability.

SUMMARY

In the wake of IMO 2020, the enhancement of a residual hydrocarbon fraction or residuum (resid) through the utilization of low sulfur, highly aromatic cracked stocks may be used to produce low sulfur fuel oil (LSFO). Enhancement of the residual base stock permits otherwise incompatible hydrocarbon streams to become viable blends for sale e.g., as a product in the LSFO market. Enhancement of resid base stocks with decant oil, cracked hydrocarbon fractions, or a combination thereof also facilitates the creation of marine and other fuels which are economically advantageous, because they use greater amounts of heavier resid in the final blend. However, the blending of heavy residuum with lighter distillates and other refined products can cause initial compatibility and/or longer term stability problems, such as asphaltene precipitation.

Asphaltenes, the high viscosity portion of asphalt that is insoluble in low molecular weight alkanes, are complex, non-specific, heavy molecular weight hydrocarbon structures typically found in crude oils and fractionations thereof. Asphaltenes are defined as the fraction of crude oils/asphalts that is insoluble in n-heptane, but that is soluble in toluene. Although generally soluble in heavier molecular weight hydrocarbons, asphaltenes precipitate out of solution upon changes in pressure, temperature, composition and even time, especially if the crude oil has been subjected to refinery cracking operations. Asphaltene precipitation causes asphaltene deposition which may lead to severe fouling and/or plugging of processing, handling, and other downstream equipment. Thus, the dilution of high sulfur fuel oils many of which have significant asphaltenes—with low sulfur distillates often causes the change in concentration that leads to asphaltene precipitation and deposition.

Applicant has recognized and found that if the base stock asphaltenic resid does not itself have sufficient stability prior to adding more paraffinic low sulfur distillates, such as sweet gas oil and/or diesel fuel and/or other middle distillates, then the blend has an increased risk of asphaltene precipitation. Applicant has further discovered that adding a high aromatic and/or resin stock to a given resid stock provides the unexpected result of improving the initial compatibility and the longer term stability of the resid stock upon blending with cutter stocks such that more paraffinic, low sulfur cutter stocks may be blended with the resid stock. Applicant has, therefore, discovered a synergistic effect of adding an aromatic rich hydrocarbon fraction, such as decant oil, to stabilize an asphaltenic resid prior to adding distillates as diluents to subsequently drive down the sulfur content to meet low sulfur specifications. In one or more embodiments disclosed herein, low sulfur marine bunker fuel oil compositions, and methods of blending such compositions, are presented to increase initial compatibility and enhance longer term stability while meeting the specifications prescribed by IMO 2020 (see ISO 8217, RMG 380).

In one or more embodiments, a low sulfur marine bunker fuel oil composition includes a decant oil, a vacuum gas oil and a residuum, such as a vacuum and/or atmospheric tower bottoms. The residuum is between about 12% to about 50% by volume of the composition and has a sulfur content of at least about 1.5% by weight. The decant oil is at least about 16% by volume of the composition and has a sulfur content of less than about 1% by weight. The vacuum gas oil is about 25% to about 74% by volume of the composition and has a sulfur content less than about 0.1% by weight. In one or more embodiments, the combined volume of the residuum and the decant oil is at least about 50% of the composition. The composition has a final sulfur content of less than about 0.5% by weight and an aromatic content of greater than about 50% and less than about 90% by weight. In one or more embodiments, the residuum and the decant oil each have a total sediment aged of greater than 0.1% by weight while the blended composition has a total sediment aged of less than 0.1% by weight.

In one or more embodiments, a low sulfur marine bunker fuel oil composition is disclosed that includes a vacuum tower resid, a decant oil and a vacuum gas oil. The vacuum tower resid is about 15% to about 25% by volume of the composition and has a sulfur content of less than about 2% by weight. The decant oil is at least about 20% by volume of the composition and has a sulfur content of less than about 1% by weight. The vacuum gas oil is about 30% to about 65% by volume of the composition and has a sulfur content less than about 0.1% by weight. In one or more embodiments, the combined volume of the vacuum tower resid and the decant oil is greater than about 35%, the low sulfur marine fuel oil composition has a final sulfur content of less than about 0.5% by weight, and the low sulfur marine fuel oil composition has an aromatic content of between about 50% and about 90% by weight. In at least one embodiment, the sulfur content of the vacuum tower resid is less than about 1.5% by weight. In one or more embodiments, the composition may also include between about 1% to about 15% by volume of a light cycle oil that has an aromatic content of greater than about 75% by weight. At least some amount of aluminum, silicon, or both may be removed from the decant oil prior to blending into the composition.

In one or more embodiments, a low sulfur marine bunker fuel composition is disclosed that includes a vacuum tower resid, a decant oil, and a vacuum gas oil. The vacuum tower resid constitutes about 15% to about 25% by volume of the composition and has a sulfur content of less than about 1.5% by weight. The decant oil constitutes about 30% to about 45% by volume of composition and has a sulfur content of less than about 1% by weight. The vacuum gas oil constitutes about 30% to about 50% by volume of the composition and has a sulfur content of less than about 0.1% by weight. In one or more embodiments, a combined volume of the vacuum tower resid and the decant oil is greater than about 50%, the low sulfur marine fuel oil composition has a final sulfur content of less than about 0.5% by weight, and the low sulfur marine fuel oil composition has an aromatic content of between about 50% and about 90% by weight. In at least one embodiment, the composition may also include between about 2% to about 8% by volume of a light cycle oil that has an aromatic content greater than about 75% by weight. In one or more embodiments, cracked stock of the decant oil and cracked stock of any light cycle oil does not exceed about 60% of the composition.

In one or more embodiments, a method for making a low sulfur marine bunker fuel oil composition that increases initial compatibility and longer term stability is disclosed. The method includes producing a resid, such as a vacuum tower bottoms or atmospheric tower bottoms, having a sulfur content of less than about 2% by weight. In one or more embodiments, such sulfur content may be less than about 1.5% by weight. The method also includes blending a decant oil having a sulfur content of less than about 1% by weight with the resid to form an intermediate blend. The method also includes blending a vacuum gas oil having a sulfur content of less than about 0.1% by weight with the intermediate blend to define the low sulfur marine bunker fuel oil composition. In one or more embodiments, the low sulfur marine bunker fuel oil composition has about 12% to about 50% by volume of the vacuum tower bottoms, at least about 16% by volume of the decant oil, and about 25% to about 74% by volume of the vacuum gas oil. The low sulfur marine fuel oil composition may also have a combined volume of the vacuum tower bottoms and the decant oil that is at least about 50%, a final sulfur content of less than about 0.5% by weight, and an aromatic content of greater than about 50% and less than about 85% by weight. In at least one embodiment, the method further includes at least partially removing at least one of aluminum or silicon from the decant oil prior to blending the decant oil with the resid. In one or more embodiments, the resid and the decant oil each have a total sediment aged of greater than 0.1% by weight, and the intermediate blend and blended composition each have a total sediment aged of less than 0.1% by weight.

In one or more embodiments, a method for blending a low sulfur fuel oil composition as a low sulfur marine bunker fuel oil is disclosed. Such method includes producing a residuum having a sulfur content of at least about 1.5% by weight with the residuum being between about 12 percent and about 50 percent by weight of the low sulfur fuel oil composition, introducing a catalytic cracked aromatic process oil into a blend tank with the residuum to form an intermediate blend, and introducing a low sulfur cutter stock selected from the group consisting of a vacuum gas oil, a cycle oil, and a diesel fuel, into the intermediate blend to define the low sulfur fuel oil composition. In one or more embodiments, the catalytic cracked aromatic process oil is the heaviest cut from a fluid catalytic cracker, has a sulfur content of less than about 0.5 percent by weight, and is at least about 16 percent by volume of the low sulfur fuel oil composition. In one or more embodiment, the low sulfur cutter stock has a sulfur content of less than about 0.15 percent by weight and is between about 25 percent and about 74 percent by volume of the low sulfur fuel oil composition. In at least one embodiment, the low sulfur fuel oil composition defined by such method has a sulfur content of less than about 0.5 percent by weight, a total aromatics content of at least about 45% by weight, and a combined concentration of residuum and catalytic cracked aromatic process oil of at least about 35% by volume.

In one or more embodiments, a method of making a low sulfur marine bunker fuel oil is disclosed. The method includes producing a vacuum tower residuum in a vacuum distillation column with the vacuum residuum having a sulfur content of less than about 2 percent by weight, or even less than about 1.5% by weight, and a total sediment aged of greater than 0.1 percent by weight, introducing a catalytic cracked aromatic process oil into a blend tank along with the vacuum tower residuum to define an intermediate blend that has a total sediment aged of less than about 0.1 percent by weight, blending an added low sulfur cutter stock with the intermediate blend in the blend tank to define the low sulfur fuel oil composition, and providing the low sulfur fuel oil composition as a low sulfur marine bunker fuel oil. In one or more embodiments, the catalytic cracked aromatic process oil is at least one of a decant oil or a cycle oil that is produced from a hydrotreated gas oil feed to a fluid catalytic cracker. The catalytic cracked aromatic process oil may also have a sulfur content of less than about 0.5 percent by weight and a total sediment aged of greater than about 0.1 percent by weight. In one or more embodiments, the low sulfur cutter stock is one or more of a vacuum gas oil or a diesel fuel and has a sulfur content of less than about 0.5 percent by weight. In at least one embodiment, the vacuum tower residuum may be between about 12 percent and about 50 percent by weight of the low sulfur marine bunker fuel oil, the catalytic cracked aromatic process oil may be at least about 16 percent by volume of the low sulfur marine bunker fuel oil, and the low sulfur cutter stock may be between about 25 percent and about 74 percent by volume of the low sulfur marine bunker fuel oil. The low sulfur marine bunker fuel oil may have a sulfur content of less than about 0.5 percent by weight, a total aromatics content of at least about 45 percent by weight, and a combined concentration of vacuum tower residuum and catalytic cracked aromatic process oil of at least about 35 percent by volume. In one or more embodiments, the low sulfur fuel oil composition is provided as a low sulfur marine bunker fuel oil without hydrotreating the low sulfur fuel oil composition after blending the low sulfur cutter stock with the intermediate blend. In at least one embodiment, the catalytic cracked aromatic process oil contributes less than about 60 weight percent of cracked stock to the low sulfur marine bunker fuel oil.

In one or more embodiments, a method of making a low sulfur marine bunker fuel oil is disclosed. The method includes obtaining a resid, such as a crude-derived atmospheric tower bottoms resid and/or crude-derived vacuum tower bottoms resid, that has an aromatics content greater than about 50 weight percent, a sulfur content less than about 2 weight percent, or even less than about 1.5%, and a total sediment aged greater than about 0.1 percent. The method also includes blending an amount of a catalytic cracked aromatic process oil with the resid to define an intermediate blend. The catalytic cracked aromatic process oil may be the bottoms cut from fractionation of a fluid catalytic cracker product. The catalytic cracked aromatic process oil may have an aromatics content greater than about 70 weight percent, a sulfur content less than about 0.5 weight percent, and a total sediment aged greater than about 0.1 weight percent. An amount of the catalytic cracked aromatic process oil is selected to achieve a total sediment aged of the intermediate blend of less than about 0.1 weight percent. The method also includes blending an amount of a low sulfur cutter stock that includes one or more of vacuum gas oil, cycle oil, or diesel fuel or other middle distillate, with the intermediate blend to define a low sulfur fuel oil blend. The low sulfur cutter stock may have a sulfur content less than about 0.5 weight percent. In one or more embodiments, the amount of the low sulfur cutter stock is selected to adjust or lower sulfur content of the low sulfur fuel oil blend below about 0.5 weight percent and adjust or increase API gravity of the low sulfur fuel oil blend to a value greater than about 11.3. The method also includes providing the low sulfur fuel oil blend as a low sulfur marine bunker fuel oil that has a total sediment aged of less than 0.1 weight percent. In at least one embodiment, the method further includes separating an amount of aluminum or silicon from the catalytic cracked aromatic process oil prior to blending the catalytic cracked aromatic process oil with the resid to reduce aluminum and silicon in the low sulfur fuel oil blend below 60 ppm. In at least one embodiment, the amount of catalytic cracked aromatic process oil is greater than about 1.5 times the amount of resid.

In one or more embodiments, a method of making a low sulfur marine bunker fuel oil is disclosed. The method includes producing a crude-derived resid in a distillation column with the crude-derived resid having an aromatics content greater than about 50 weight percent and a sulfur content less than about 2 weight percent, or even less than about 1.5 weight percent. The crude-derived resid may be one or more of an atmospheric tower bottoms resid or a vacuum tower bottoms resid and may have a total sediment aged of greater than about 0.1 weight percent. The method also includes adding an aromatic rich hydrocarbon fraction and the resid into a tank. The aromatic rich hydrocarbon fraction, which may be one or more of a decant oil or a cycle oil, may have an aromatics content greater than about 70 weight percent, a sulfur content less than about 0.5 weight percent, and a total sediment aged greater than about 0.1 weight percent. The method also includes blending the aromatic rich hydrocarbon fraction and the resid in the tank to define an intermediate blend. The aromatic rich hydrocarbon fraction is blended in an amount relative to an amount of the resid to achieve a total sediment aged of the intermediate blend of less than about 0.1 weight percent. The method also includes adding a low sulfur cutter stock into the tank with the intermediate blend. The low sulfur cutter stock may have a sulfur content less than about 0.5 weight percent and be one or more of a vacuum gas oil, cycle oil, or diesel fuel or other middle distillate. The method also includes blending the low sulfur cutter stock and the intermediate blend in the tank to define a low sulfur oil blend that has a sulfur content below 0.5 weight percent and an API gravity greater than about 11.3 after blending the low sulfur cutter stock with the intermediate blend. The method also includes outputting the low sulfur fuel oil blend as a low sulfur marine bunker fuel oil having a total sediment aged of less than 0.1 weight percent. In at least one embodiment, the aromatic rich hydrocarbon fraction and any cycle oil of the low sulfur cutter stock together contribute less than about 60 weight percent of cracked stock to the low sulfur marine bunker fuel oil. In one or more embodiments, the low sulfur cutter stock is a combination of a light cycle oil and a vacuum gas oil.

In one or more embodiments, a method of making a low sulfur marine bunker fuel oil is disclosed. The method includes obtaining a crude-derived vacuum tower bottoms resid that has an aromatics content greater than about 40 weight percent, a sulfur content less than about 2 weight percent, or even less than 1.5 weight percent, and a total sediment aged of greater than about 0.1 weight percent. The method also includes introducing an amount of an aromatic rich hydrocarbon fraction into a blend tank along with the vacuum tower bottoms resid. The aromatic rich hydrocarbon fraction has an aromatic content greater than about 70 weight percent, a sulfur content less than about 0.5 weight percent, and a total sediment aged greater than about 0.1 weight percent and may be at least one of a decant oil or a cycle oil. The method also includes blending the aromatic rich hydrocarbon fraction and the vacuum tower bottoms resid in the blend tank to define an intermediate blend. In one or more embodiments, the amount of aromatic rich hydrocarbon fraction blended is sufficient to achieve a total sediment aged of the intermediate blend of less than about 0.1 weight percent. The method also includes introducing an amount of a low sulfur cutter stock into the blend tank with the intermediate blend. The low sulfur cutter stock may have a sulfur content of less than about 0.5 weight percent and be one or more of vacuum gas oil, cycle oil, or diesel fuel or other middle distillate. The method may also include blending the low sulfur cutter stock and the intermediate blend in the blend tank to define a low sulfur fuel oil blend. In one or more embodiments, the amount of the low sulfur cutter stock introduced into the blend tank is sufficient to adjust, e.g., by lowering, sulfur content of the low sulfur fuel oil blend below 0.5 weight percent and adjust, e.g., by increasing, the API gravity of the low sulfur fuel oil blend to a value greater than about 11.3. The method may also include providing the low sulfur fuel oil blend as a low sulfur marine bunker fuel that has a total sediment aged less than 0.1 weight percent. In one or more embodiments, the low sulfur fuel oil blend may have between about 12 volume percent and about 50 volume percent of vacuum tower bottoms resid, a greater amount by volume of the aromatic rich hydrocarbon fraction than the vacuum tower bottoms resid, and/or between about 25 volume percent and about 74 volume percent of the low sulfur cutter stock. In at least one embodiment, the vacuum tower bottoms resid and the aromatic rich hydrocarbon fraction may be greater than 50 volume percent of the low sulfur fuel oil blend.

In one or more embodiments, a method of making a low sulfur marine bunker fuel oil is disclosed. The method may include producing a crude-derived vacuum tower bottoms resid that has an aromatics content greater than about 50 weight percent, a sulfur content less than about 1.5 weight percent, and a total sediment aged greater than about 0.1 weight percent. The method may also include hydrotreating a gas oil in a hydrotreater, introducing the hydrotreated gas oil to a fluid catalytic cracker, and operating the fluid catalytic cracker to produce a fluid catalytic cracker product. The method may also include adding a decant oil into a blend tank with the vacuum tower bottoms resid. The decant oil has an aromatic content greater than about 70 weight percent, a sulfur content less than about 0.5 weight percent, and a total sediment aged greater than about 0.1 weight percent. In one or more embodiments, the decant oil is a bottoms fraction from fractionation of the fluid catalytic cracker product. The method may also include blending the decant oil and the vacuum tower bottoms resid in the blend tank to define an intermediate blend that has an amount of the decant oil relative to the amount of the resid to achieve a total sediment aged of the intermediate blend of less than about 0.1 weight percent. The method also includes adding a low sulfur cutter stock that has a sulfur content less than about 0.5 weight percent and is at least two of vacuum gas oil, light cycle oil, or diesel fuel or other middle distillates. The method includes blending the low sulfur cutter stock and the intermediate blend to define a low sulfur fuel oil blend that has a sulfur content less than about 0.5 weight percent and an API gravity greater than about 11.3. The low sulfur fuel oil blend is then outputted as a low sulfur marine bunker fuel oil that has a total sediment aged of less than 0.1 weight percent. In at least one embodiment, the decant oil and any cycle oil of the low sulfur cutter stock together contribute between about 30 weight percent and about 50 weight percent of cracked stock to the low sulfur marine bunker fuel oil such that the CCAI of the low sulfur marine bunker fuel oil is maintained between about 840 and about 860.

BRIEF DESCRIPTION OF DRAWINGS

These and other features, aspects, and advantages of the disclosure will become better understood with regard to the following descriptions, claims, and accompanying drawings. It is to be noted, however, that the drawings illustrate only several embodiments of the disclosure and, therefore, are not to be considered limiting of the scope of the disclosure.

DETAILED DESCRIPTION

Figure 1:
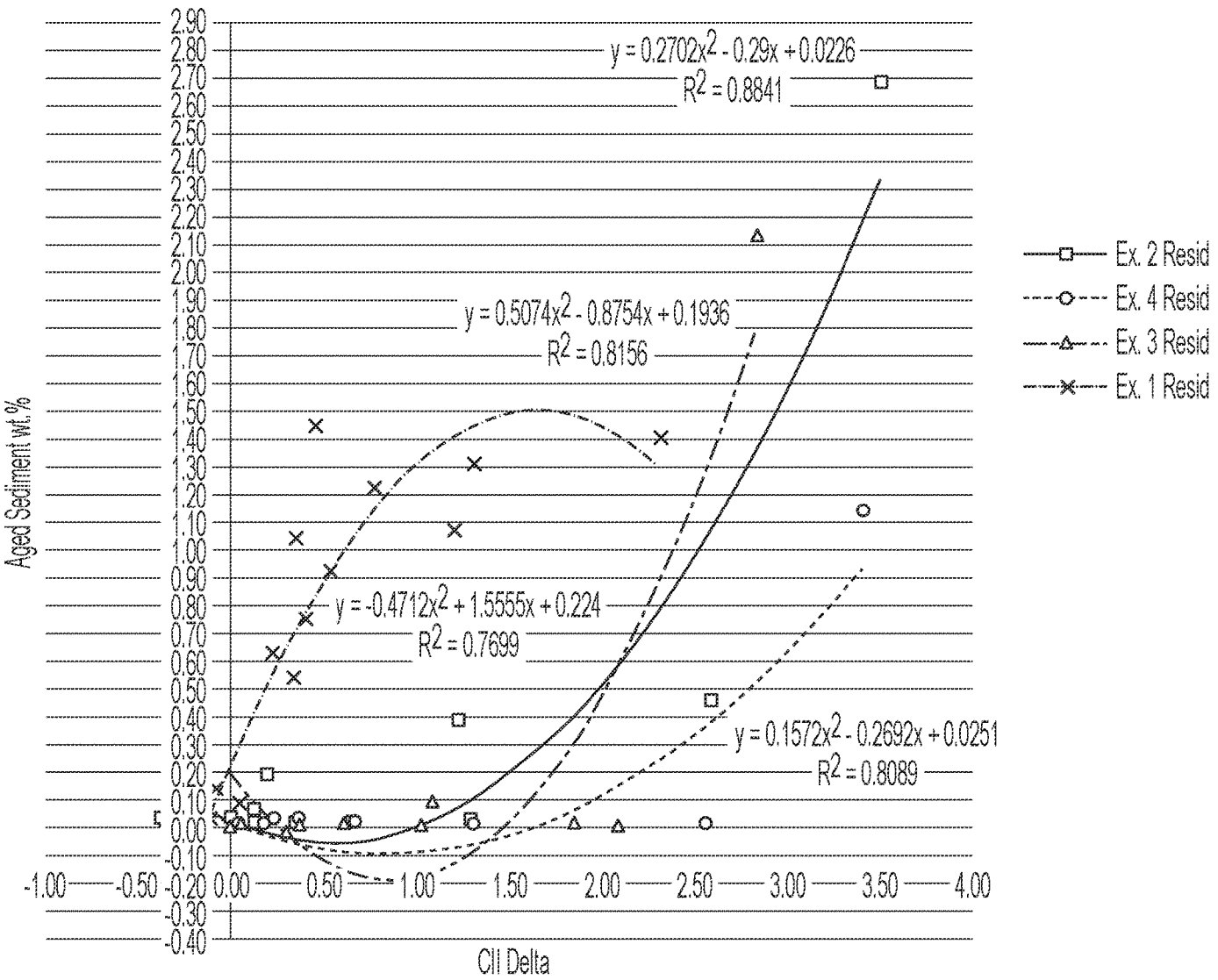
FIG. 1 is a plot of aged sediment values (in weight percent) versus colloidal instability index delta for a number of resid base stocks according to one or more embodiments of the disclosure.

So that the manner in which the features and advantages of the embodiments of the compositions and related methods disclosed herein, as well as others, which will become apparent, may be understood in more detail, a more particular description of embodiments of compositions and related methods briefly summarized above may be had by reference to the following detailed description of embodiments thereof, in which one or more are further illustrated in the appended drawings, which form a part of this specification. It is to be noted, however, that the drawings illustrate only various embodiments of the compositions and related methods disclosed herein and are therefore not to be considered limiting of the scope of the compositions and related methods disclosed herein as it may include other effective embodiments as well.

With the implementation of lower sulfur specifications for marine fuel oil under IMO 2020, refiners have turned to blending high sulfur refinery products, such as resid, with low sulfur distillates to meet the low sulfur and other fuel specifications. However, the blend must have initial compatibility in order to prevent asphaltenes suspended in the heavy blend fraction from precipitating out of solution upon blending. Moreover, the blend must also have longer term stability, such that the asphaltenes present in the heavy blend fraction remain in solution over time during sale, distribution, and other outputting, e.g., during storage and/or transport.

Applicant has recognized and found that if the base stock asphaltenic resid does not itself have sufficient stability prior to adding more paraffinic low sulfur distillates, such as sweet gas oil and/or diesel fuel, then the blend has an increased risk of asphaltene precipitation. This discovery, for example, is more than just the general perception that asphaltene precipitation increases as the density variation between asphaltenic resid and cutter stocks increases. Here, Applicant has recognized that the base stock asphaltenic resid, e.g., either the atmospheric tower bottoms or vacuum tower bottoms, must itself have a degree of stability prior to adding more paraffinic low sulfur distillates, such as sweet gas oil and/or diesel fuel or other middle distillates.

The colloidal instability index (CII) is one approach, and is often used, to ascertain the instability of a crude oil. CII is computed from a SARA analysis, which is a measure of the chemical composition of the aromatics, resins, saturates, and asphaltenes in a sampled hydrocarbon. CII is expressed as the ratio of the sum of asphaltenes and saturates to the sum of aromatics and resins. Although traditionally used with respect to crude oils, CII has been extrapolated and used to ascertain the stability of fractions of heavier oils, such as resids. Generally, if the CII is less than 0.7, then the hydrocarbon is stable, but if the CII is greater than 0.9, then the hydrocarbon is unstable and likely to precipitate asphaltenes. A CII between 0.7 and 0.9 represents a region of moderate stability or growing instability.

Applicant also has discovered that CII data, when computed for some severely cracked resids, is misleading with respect to compatibility and stability. For example, Table I below lists characteristics of several example resid base stock, including their SARA analysis and CII data:

TABLE I

| | SHORT RESID | | | |
|---|---|---|---|---|
| | Ex. 1 | Ex. 2 | Ex. 3 | Ex. 4 |
| SPG @ ~15° C. | 1.03 | 0.99 | 1.03 | 0.97 |
| Visocisty @ ~50° C. (cSt) | 473.78 | 355.43 | 1200 | 888.93 |
| Sulfur (wt %) | 1.74 | 2.51 | 0.54 | 1.38 |
| Pour Point (° C.) | | | | 53.6 |
| Flash Point (° C.) | 178 | | | 99 |
| API Gravity @ ~60° F. | 5.8 | 11.9 | 5.4 | 14.3 |
| Heptane Insolubles | 6.42 | 8.78 | 6.94 | 8.55 |
| Saturates | 10.38 | 15.7 | 12.81 | 12.42 |
| Aromatics | 70.16 | 50.06 | 49.25 | 46.93 |
| Resins | 10.32 | 20.88 | 26.95 | 19.86 |
| Asphaltenes | 9.12 | 13.34 | 10.99 | 20.77 |
| Aromatics/Resins | 6.80 | 2.40 | 1.83 | 2.36 |
| CII | 0.242 | 0.409 | 0.312 | 0.499 |
| Solubility $S_{BN}$ | 110 | | | 140 |
| Insolubility $I_N$ | 76 | | | 40 |

The first resid, labeled as Ex.1, is a crude-derived vacuum tower bottoms resid that is further processed and may be characterized as being severely cracked. The high aromatic content at about 70 percent is indicative of a severely cracked resid. But, the CII for this fraction is 0.24, which is indicative of a very stable hydrocarbon one that should not precipitate asphaltenes upon blending with low sulfur distillates. Applicant has further found, however, that this Ex.1 resid fraction, is problematic and readily precipitates asphaltenes upon blending with low sulfur distillates and cutter stock, such as sweet gas oil and/or diesel fuel or other middle distillates, e.g., jet fuel, kerosene, etc.

FIG. 1 illustrates the total sediment aged (i.e., potential total sediment or aged sediment) versus CII Delta for each of the resid fractions provided in TABLE I, including the Ex. 1 resid fraction, according to one or more embodiments of the disclosure. Along the y-axis, the total sediment aged, computed per the prescribed test method ISO 10307-1, represents the total weight percent of sediment (e.g., asphaltenes) that can be precipitated under normal storage conditions. The total sediment aged is a characteristic of the fuel oil that for marine fuel oils must be under 0.1% weight per the IMO 2020 requirements. Along the x-axis, the CII Delta represents the amount of change in CII from original (e.g., the change in CII Delta that could be caused by blending a particular resid with cutter stocks). Thus, the total aged sediment versus CII Delta plot provides some insight as to how much dilution of the residual fraction by cutter stocks is possible before asphaltene precipitation may occur. In other words, if the residual fraction is capable of cutter stock dilution while increasing the CII prior to asphaltene precipitation, then the residual fraction is capable of withstanding at least some destabilization of its natural matrix.

As illustrated in FIG. 1, the Ex.1 resid fraction, represented by the polynomial fitted curve based on the "x" data points, is well above the 0.1% weight total sediment aged for any positive CII Delta, or change in CII, of a blend comprising the resid fraction. In fact, the CII of the Ex.1 resid fraction needs to be reduced even further to allow any amount of blending with cutter stock. One way to decrease the computed CII for this resid is to increase the aromatic and/or resin content of the fraction. This may be accomplished by blending in a hydrocarbon fraction that is higher in aromatics and/or resins. Here, if the final blend of Ex.1 resid can attain a total of about 85% by weight of aromatics and/or resins, then the computed CII may be decreased by about 0.177, which permits some additional blending with low sulfur cutter stocks. With respect to the other three resid fractions, Ex.2, Ex.3, and Ex.4, which were less severely refined, FIG. 1 shows that the corresponding polynomial fitted curve for each resid fraction has a positive CII Delta, which permits at least some blending of cutter stocks directly with the particular resid fraction, prior to the total sediment aged increasing to above 0.1% by weight.

Applicant has thus still further recognized that adding a high aromatic and/or resin stock, such as a decant oil, to a given resid stock provides the unexpected result of improving the initial compatibility and the longer term stability of the resid stock upon blending with cutter stocks such that more paraffinic, low-sulfur cutter stocks may be blended with the resid stock. A decant oil, otherwise known as DCO or slurry oil, is a catalytic cracked aromatic process oil that is the heaviest cut from a fluid catalytic cracker.

Figure 2:
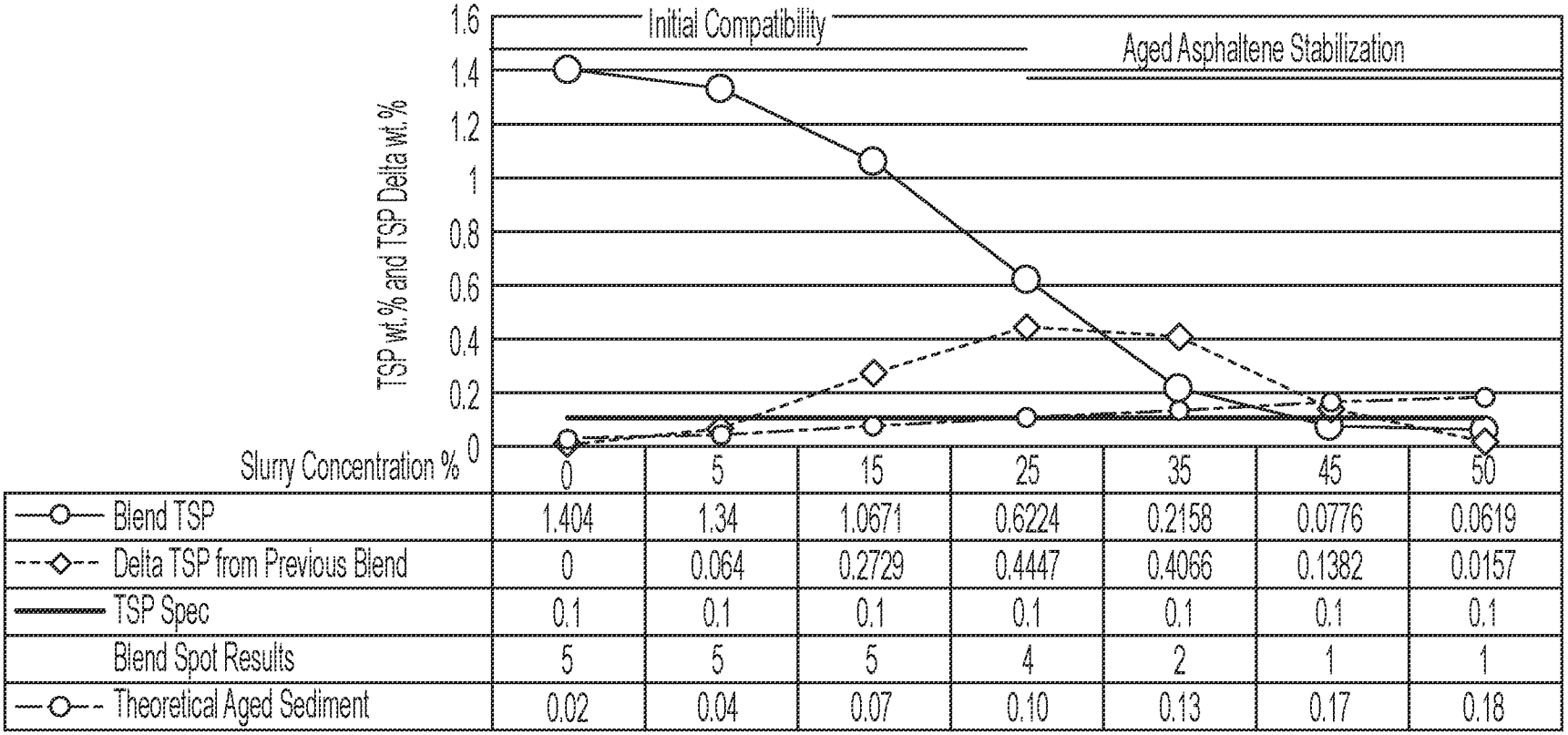
FIG. 2 is a plot showing the synergistic effect of decant oil addition to a resid base stock according to one or more embodiments of the disclosure.

FIG. 2 illustrates plots of total sediment aged (TSP or total sediment potential or potential total sediment) versus weight percentage of decant oil blended with 25% by weight of the severely refined Ex.1 resid described above. The Ex.1 resid does not readily blend with diluent streams and doing so generally leads to asphaltene precipitation. As recognized by Applicant, the Ex.1 resid must first be stabilized by blending the resid with a highly aromatic or resin-containing fraction. An example of such a highly aromatic fraction may include decant oil (DCO or slurry oil), which has an aromatic content of greater than 70%, greater than 75%, greater than 80%, greater than 85%, or even greater than 90%, each by weight. As shown in TABLE II below, the decant oil of FIG. 2 (that is blended with Ex.1 resid) has an aromatic content of about 86% by weight, which is higher than the aromatics content of the Ex.1 resid. Even so, spot test evaluation shows that the Ex.1 resid had significant initial incompatibility even upon addition and blending with decant oil.

TABLE II

| | DISTILLATE | | | |
|---|---|---|---|---|
| | Decant Oil | LSVGO | HTGO | HPVGO |
| SPG @ ~15° C. | 1.08 | 0.90 | 0.91 | 0.90 |
| Viscosity @ ~50° C. (cSt) | 189.68 | 23.35 | | |
| Sulfur (wt %) | 0.30 | 0.05 | 0.53 | 0.05 |
| Pour Point (° C.) | −1 | 24 | | |
| Flash Point (° C.) | 109.5 | 159.0 | | |
| API Gravity @ ~60° F. | −0.3 | 25.3 | 22.6 | 22.3 |
| Heptane Insolubles | 0.29 | 0.17 | <0.1 | <0.1 |
| Saturates | 10.05 | 56.12 | 42.50 | 55.78 |
| Aromatics | 86.45 | 41.85 | 56.40 | 43.42 |
| Resins | 2.4 | 0.53 | 0.8 | 0.8 |
| Asphaltenes | 1.1 | 0 | 0.3 | 0 |
| CII | 0.125 | 1.324 | 0.748 | 1.261 |
| Solubility $S_{BN}$ | 176 | 44 | 41 | 32 |
| Insolubility $I_N$ | 69 | 0 | 0 | 0 |

As shown in FIG. 2, however, the aged sediment (TSP) for the Ex.1 resid and decant oil blends showed improvement with each incremental addition of decant oil. Looking at the square dashed line, the most significant improvements in total sediment aged measurements were achieved when the spot test results of the blend improved (see corresponding Blend Spot Results). This indicates that the decant oil alleviated initial incompatibility and caused the improvement in stability when exposed to thermal and oxidative stress. The transition from about 25% to about 35% by weight decant oil represents another significant improvement which indicates both that the initial incompatibility has drastically improved and that the stability of the asphaltenes in regard to ageing has greatly improved. Looking at the circle solid line, it is significant that at 35% by weight decant oil, the aged sediment has nearly met the theoretical aged sediment, and subsequently falls below the theoretical aged sediment at 45% by weight decant oil thus indicating a continual, synergistic improvement in the compatibility and stability of asphaltenes in the blend. Here, the theoretical aged sediment is the summation of the computed aged sediment of each blend component—the Ex.1 resid and the decant oil (see TABLES I and II, which give characteristics of the blend components).

Applicant has, therefore, discovered a synergistic effect of adding an aromatic rich hydrocarbon fraction, such as decant oil or cycle oil, to stabilize an asphaltenic resid prior to adding distillates as diluents to subsequently drive down the sulfur content. This synergetic effect, as shown in FIG. 2, occurs when the addition of decant oil above about 40% causes the blend TSP to fall below the theoretical aged sediment and the upper limit of the TSP (i.e., 0.1 wt %) for a marine bunker fuel oil.

Figure 3:
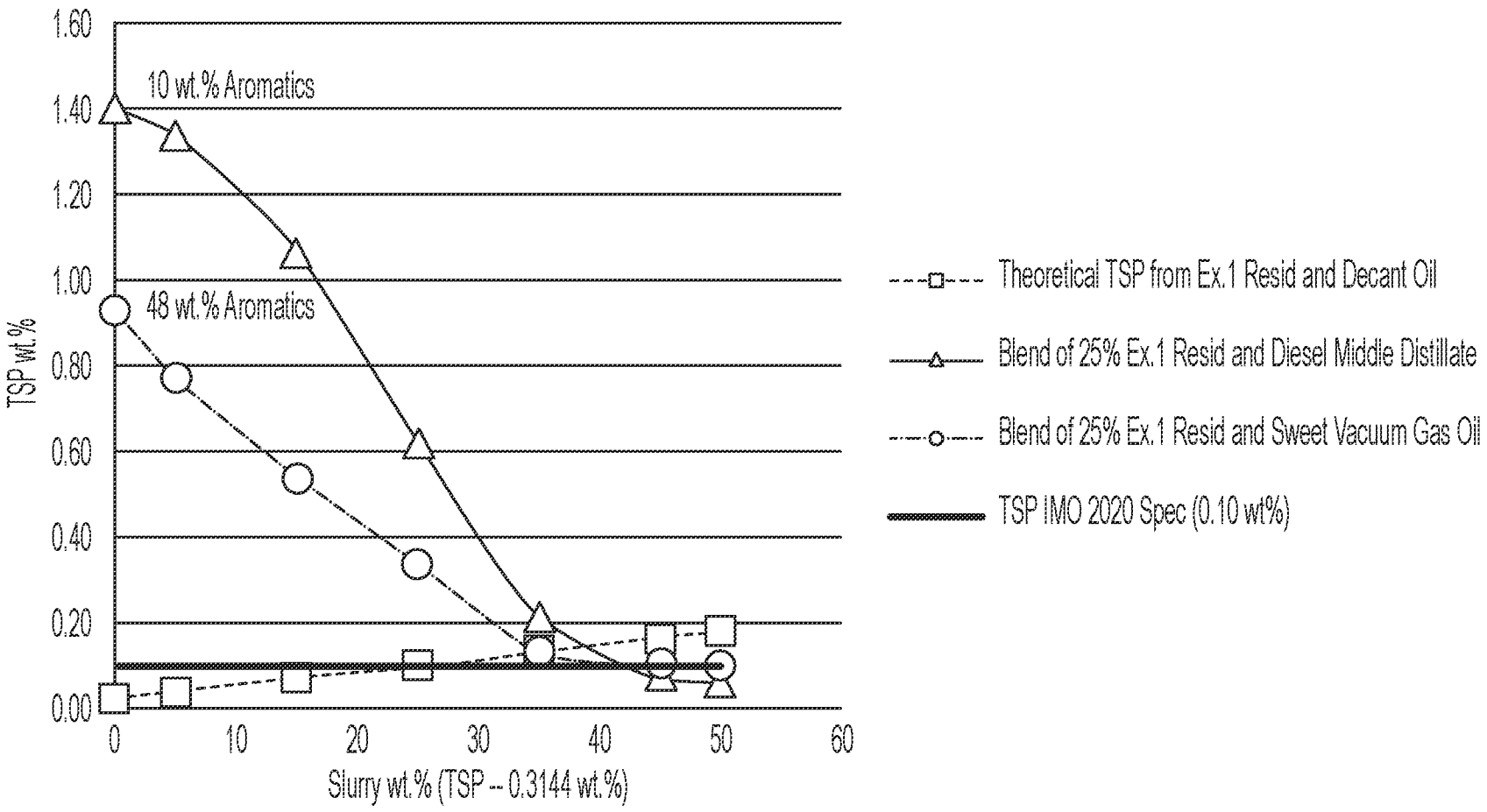
FIG. 3 is a plot showing the synergistic effect of decant oil addition to a fraction of resid base stock and the effect of aromatic content of the cutter stock on final blend with respect to initial compatibility and longer term stability, according to one or more embodiments of the disclosure.

FIG. 3 represents the severely refined Ex.1 resid described above that is blended with the decant oil and either a diesel middle distillate (triangle dashed line) or a sweet vacuum gas oil (circle dashed line). The square dashed line at the bottom represents the theoretical aged sediment for the blends based on aged sediment of the individual base stocks (e.g., summation of aged sediment values for each individual fraction in the blend). Both the diesel middle distillate and the sweet vacuum gas oil, each used as cutter stock to dilute the Ex.1 resid fraction and decant oil, have total sediment aged values less than 0.01 wt %. Additionally, the diesel middle distillate has an aromatics concentration of about 10 wt % and the sweet vacuum gas oil has an aromatics content of about 48 wt %. The TSP of the decant oil is about 0.31 wt %, which by itself is greater than the TSP specification under IMO 2020. Likewise, FIG. 3 shows that when the 25% Ex.1 resid fraction is mixed with 75% of either diesel middle distillate or sweet vacuum oil—and no decant oil also has TSP values well above the IMO 2020 limit (i.e., about 1.4 wt % TSP for 25% Ex.1 resid and balance diesel middle distillate and about 0.95 wt % TSP for 25% Ex.1 resid and balance sweet vacuum oil).

Therefore, FIG. 3 again illustrates the synergy of the resid fraction and decant oil blend, including the unexpected result that the TSP of the blend, along with corresponding concentrations of cutter stock, decreases below 0.1 wt % TSP at increasing concentrations of decant oil to Ex.1 resid and cutter stock, even though the TSP of the individual fractions of Ex.1 resid and decant oil are both greater than 0.1 wt % TSP. Moreover, as shown in FIG. 3, the aromaticity of the cutter stock (i.e., whether diesel middle distillate or sweet vacuum gas oil) in the blend is significant to the measured total sediment aged. In both blends, the TSP falls below the 0.10 wt % specification when the decant oil has increased to above about 43%. Notably, the blend of 25% Ex.1 resid and sweet vacuum gas oil falls below the TSP limit first (at about 40 wt % decant oil), because of the increased aromatics concentration in the sweet vacuum gas oil (as compared to the diesel middle distillate).

Figure 4:
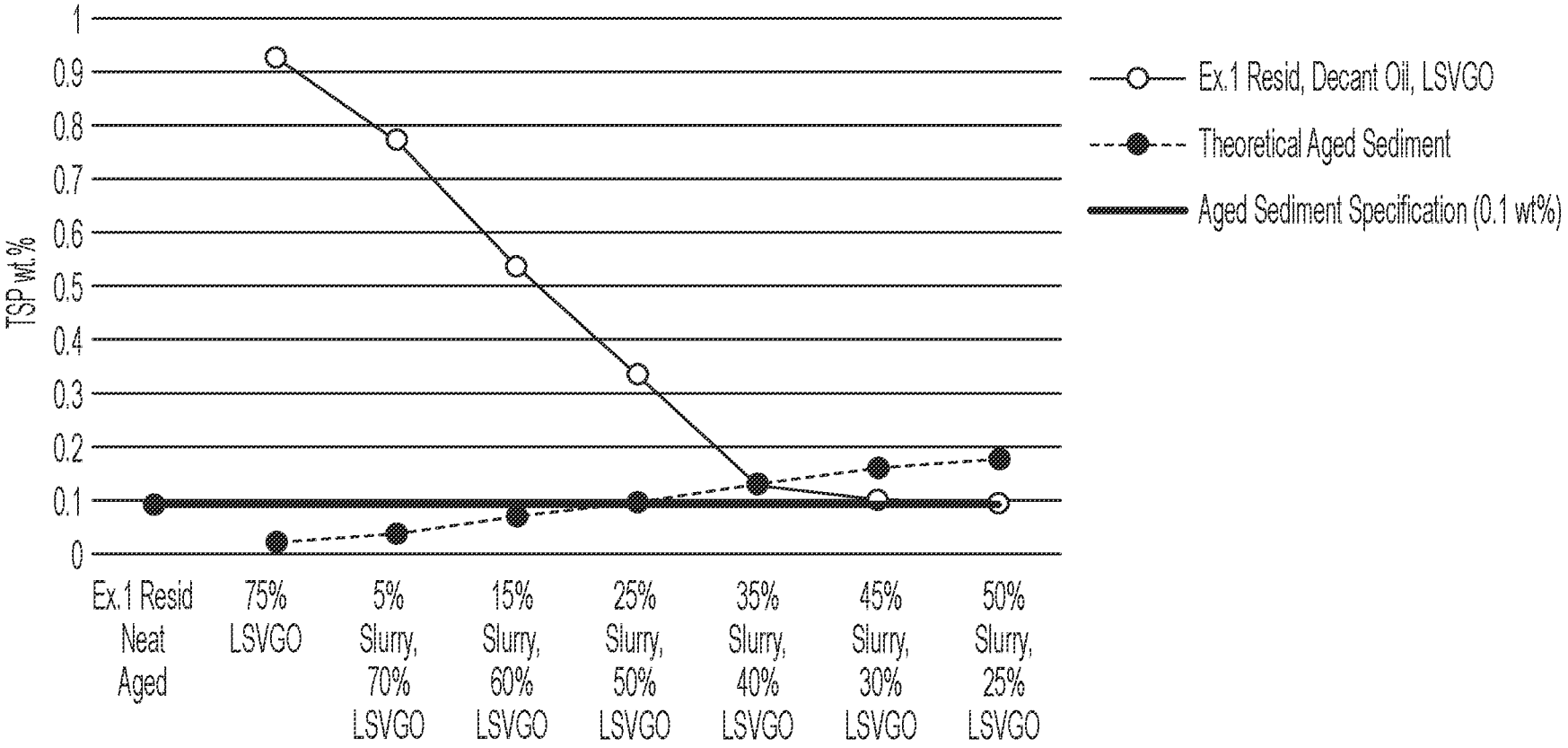
FIG. 4 is a plot showing the synergy of mixing a resid with decant oil to stabilize the resid so that upon further dilution with low sulfur cutter stock to meet sulfur specifications, the blend is initially compatible and remains stable over time, according to one or more embodiments of the disclosure.

FIG. 4 represents the severely refined Ex.1 resid described above (see TABLE I) that is blended with decant oil and LSVGO (see TABLE II). As clearly shown in FIG. 4, the aged sediment value of the neat Ex.1 resid alone is just above 0.1 wt %, the aged sediment specification for LSFO (see left side of FIG. 4). However, dilution of the 25% Ex.1 resid fraction with 75% LSVGO alone creates significant asphaltene instability, which causes the TSP value to approach nearly 1 wt. %. The declining slope of the solid line on FIG. 4 (after its peak between 0.9 wt % and 1.0 wt % TSP) shows that the addition of decant oil or slurry oil in place of LSVGO helps to mitigate or alleviate this instability. Additionally, with respect to blends having between about 5 wt % and about 15 wt % decant oil, the initial spot test evaluations show significant incompatibility but significant improvement in aged sediment, as will be understood by those skilled in the art. The incremental increase of decant oil eventually alleviates, or at least mitigates, initial incompatibility and improves aged sediment values to below specification limits for TSP under ISO 2020. At a blend of about 35% decant oil, 40% LSVGO and 25% Ex.1 resid, the calculated TSP crosses below the theoretical TSP—the summation of the TSP for each blend component. Starting here and for decant oil concentrations greater than about 35%, an unexpected synergistic effect is imparted to the blend in that the calculated TSP of the blend as a whole is lower than the summation of the TSP values of the individual blend components. Further, as the blend approaches about 45% decant oil and thereabove, the blend falls below the aged sediment specification for LSFO of 0.1 wt %. Again, FIG. 4 illustrates the synergy of mixing a resid with decant oil to stabilize the resid so that upon further dilution with low sulfur cutter stock to meet sulfur specifications, the blend is initially compatible and remains stable over time.

Resid fractions having high concentrations of decant oils (slurry) may cause the final LSFO blends to be out of specification due to high metal concentrations. Under IMO 2020 (see ISO 8217, RMG 380), LSFO has a maximum limit of 60 ppm of combined aluminum plus silicon content. FCC catalysts typically have a silicon and/or aluminum support matrix that incorporates rare earth metals for catalytic activity. Decant oils (slurry), which are produced by the FCC unit, can contain high amounts of FCC catalyst fines, largely composed of aluminum and/or silicon. However, the presence of these fines in the decant oil (slurry) can be eliminated by filtering decant oil (slurry) off of the FCC unit before blending. In one or more embodiments, at least partial amounts of aluminum and/or silicon may be removed from the decant oil (slurry) prior to further blending, e.g., by filtering, decanting, electric field separation, centrifuge, etc. With respect to the electric field separation, a Gulftronic electrostatic separator manufactured by General Atomics of San Diego, Calif. may be used to remove FCC catalyst fines from the decant/slurry oil.

Figure 5:
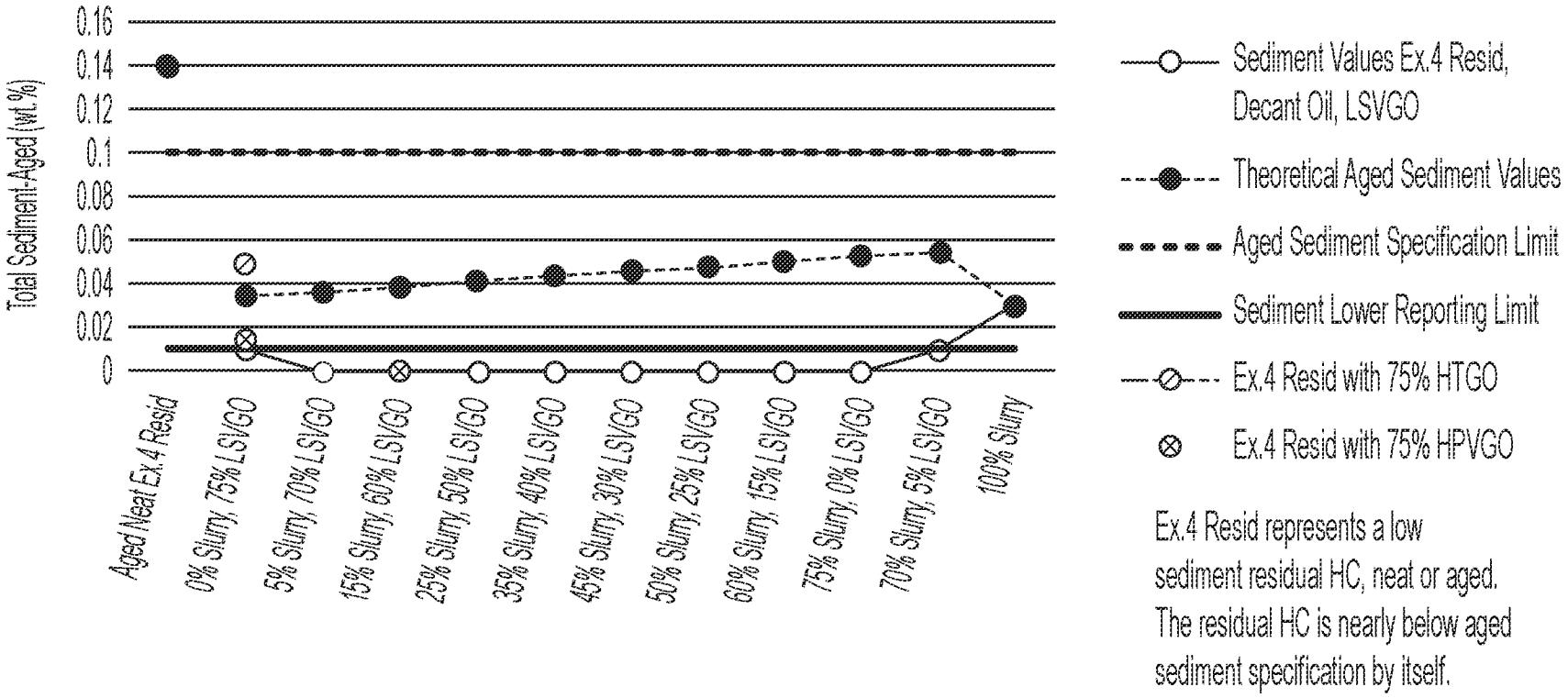
FIG. 5 is a plot showing the synergistic effect of decant oil addition to another resid base stock along with subsequent dilution by cutter stock according to one or more embodiments of the disclosure.

FIG. 5 further illustrates yet another example of the above-described synergy between the resid fraction and decant oil but with respect to a more mildly refined residual base stock, namely Ex.4 resid. As presented above with respect to FIG. 1, the Ex.4 resid permits at least some blending of cutter stocks directly, prior to the total sediment aged increasing to above 0.1% by weight. Turning to FIG. 5, the aged sediment of the Ex.4 resid alone is computed to be about 0.14%, which is well above the maximum permitted limit of 0.10% under IMO 2020. When 75% of a low sulfur vacuum gas oil is added to improve flow properties of the final blend, then the total aged sediment of the blend, including the Ex.4 resid, drops well below the aged sediment specification limit line to about 0.01%, which is the sediment lower reporting limit (see "0% Slurry (decant oil), 75% LSVGO" on the x-axis). Here, dilution with low sulfur vacuum gas oil shows a significant reduction in aged sediment indicating that no significant asphaltene precipitation occurred by addition of the vacuum gas oil. The circle dashed line represents the theoretical aged sediment value after testing components individually and computation according to ISO 10307-1. TABLES I and II provide the SARA analysis and density of Ex.4 resid and LSVGO components, respectively, shown in FIG. 5.

As can be seen in FIG. 5, the addition of greater percentages of decant oil (relative to low sulfur vacuum gas oil) further drives down the aged sediment of the blended fuel oil such that the circle solid line remains well below even the sediment lower reporting limit. It should also be noted that decant oil itself has total aged sediment of approximately 0.3% by weight. Yet, the synergistic effect of the blend of Ex.4 resid and LSVGO is abundantly clear when the blend is composed of just Ex.4 resid and decant oil 25% by weight Ex.4 resid and 75% by weight decant oil. As shown on FIG. 5, this particular blend has a total sediment aged right at the sediment lower reporting limit, which is below the maximum permissive value of 0.1% under IMP 2020, and incredibly, also below the aged sediment of either component individually (e.g., 0.14% for 100% Ex.4 resid and 0.3% for 100% slurry). Further, looking at the circle dashed line, it is significant that between 5% and 75% by weight of decant oil and for the indicated weight percentages of LSVGO, the aged sediment remains well below the theoretical aged sediment thus indicating a continual, synergistic improvement in the compatibility and stability of asphaltenes in the blend. Here again, the theoretical aged sediment is the summation of the computed aged sediment of each blend component—the Ex.4 resid, the decant oil and the LSVGO (see TABLES I and II).

Indeed, the importance of this result is not in the stability itself, but rather the synergistic effect of the combination of the resid and decant oil to further permit blending of low-sulfur cutter stocks. Also shown in FIG. 5 is partial data for the Ex.4 resid blended with two other vacuum gas oils, HTGO and HPVGO. In both cases, the dilution by the respective vacuum gas oil (TABLE II) provides equal or better overall stability. For example, the 25% Ex.4 resid and 75% HPVGO blend did improve the total sediment aged to below 0.01 wt. %. Similarly, the 25% Ex. 4 resid and 75% HTGO blend had a total sediment aged below 0.01 wt. %. Moreover, when 15% slurry was added to the 60% HTGO and 25% resid blend, the total sediment aged was near zero.

In one or more embodiments, resids, such as vacuum tower bottoms or atmospheric tower bottoms, may be blended with low sulfur cutter stocks to create LSFO meeting the 0.5% maximum sulfur content required by IMO 2020 (see ISO 8217, RMG 380). However, the dilution of asphaltenic resids—those resids having asphaltenes with cutter stocks high in saturate content may disrupt the supportive matrix, thought to be provided by resins, in the resid, which can lead to asphaltene precipitation and sediment formation. Highly aromatic stocks, such as slurry/decant oil, can be blended with the resid to stabilize the asphaltenes and improve both initial compatibility and long-term (aged) stability of the final LSFO blend. In some cases, synergistic effects are noted in which the aged sediment of the blend is lower than the starting residual and low sulfur blend components. Similarly, aromatic stocks can be used as a stabilizing binder for blending incompatible finished LSFOs as long as the final product specifications are not violated.

Disclosed herein, therefore, are low sulfur marine bunker fuel oil blends, and methods of making such blends, to improve initial compatibility and aged stability of asphaltenic resids. The blending of resid fractions with dense, aromatic decant (DCO)/slurry oils, created from hydrotreated FCC feed, prior to final dilution, or the blending of resid fractions with cracked hydrocarbon fractions solely, or a combination thereof, facilitates in lowering the overall sulfur content of the blend to meet the LSFO specification, e.g., IMO 2020, while minimizing density changes and providing added aromaticity to support asphaltene stability. It will be understood that the ratios for final LSFO blend components may be adjusted to meet the sulfur and other fuel specifications.

As is known to those skilled in the art, resid or residuum is any refinery fraction left behind after distillation. Resid may refer to atmospheric tower bottoms and/or vacuum tower bottoms.

Atmospheric tower bottoms (ATB), also called long resid, is the heaviest undistilled fraction (uncracked) in the atmospheric pressure distillation of a crude oil, as is known to those skilled in the art. ATB has crude oil components with boiling points above about 650° F. (343° C.), which is below the cracking temperature of the crude oil.

Vacuum tower bottoms (VTB), also called short resid, is the heaviest undistilled fraction (uncracked) in the vacuum distillation of a hydrocarbon feedstock, as is known to those skilled in the art. VTBs may have one or more of the following characteristics: a density at 15° C. of between about 0.8 and about 1.1 g/ml, a sulfur content of between about 1.0 and about 3.0 wt %, a pour point of between about −20 and about 75° C., a kinematic viscosity of between about 50 and about 12,000 cSt (50° C.), a flash point of between about 50 and about 200° C., and an API density of between about 3.0 and about 20. Moreover, VTBs generated from sweet run hydrocarbon feedstock (e.g., hydrotreated feedstock to the vacuum tower) may have sulfur content below about 1.0 wt %, below about 0.9 wt %, below about 0.8 wt %, below about 0.7 wt %, below about 0.6 wt %, below about 0.5 wt %, below about 0.4 wt %, below about 0.3 wt % or even below about 0.2 wt %.

Decant oil (DCO), also known as slurry oil, is a high-boiling catalytic cracked aromatic process oil and is the heaviest cut off of a fluid catalytic cracker unit, as is known to those skilled in the art. Decant oil may have one or more of the following characteristics: a density at 15° C. of between about 0.9 and about 1.2 g/ml, a sulfur content of between about 0.20 and about 0.50 wt %, a pour point of between about −5 to about 5° C., a kinematic viscosity of between about 100 and about 200 cSt (50° C.), a flash point between about 50 and about 150° C., and an API of between about −1.0 and about 1.0.

Vacuum gas oil (VGO) may be light and/or heavy gas oil cuts from the vacuum distillation column, as is known to those skilled in the art. VGO may have one or more of the following characteristics: a density at 15° C. of between about 0.85 and about 1.1 g/ml, a sulfur content of between about 0.02 and about 0.15 wt %, a pour point of between about to 15 about 35° C., a kinematic viscosity of between about 15 and about 35 cSt (50° C.), a flash point between about 100 and about 175° C., and an API of between about 15 and about 30.

Cycle oil is the diesel-range, cracked product from the fluid catalytic cracker unit, as is known to those skilled in the art. Cycle oil may be light, medium or heavy and may have one or more of the following characteristics: a density at 15° C. of between about 0.75 and about 1.0 g/ml, a sulfur content of between about 0.01 and about 0.25 wt %, a kinematic viscosity of between about 2 and about 50 cSt (50° C.), a flash point between about 50 and about 70° C., and an API of between about 25 and about 50.

In one or more of such blends, about 5 to about 80 percent by volume of an atmospheric tower bottoms, vacuum tower bottoms, or a combination of both is utilized as a base stock. The resid base stock imparts viscosity and compatibility to the blend, but tends to be high in sulfur content, and may be between about 1.0 to about 2.0 or more by weight percent, which is well above the IMO 2020 sulfur specification of 0.5 weight percent. In one or more embodiments, the sulfur content of the resid base stock (i.e., atmospheric tower bottoms, vacuum tower bottoms, or a combination of both) may be greater than 1.0 wt %, greater than 1.1 wt %, greater than 1.2 wt %, greater than 1.3 wt %, greater than 1.4 wt %, greater than 1.5 wt %, greater than 1.6 wt %, greater than 1.7 wt %, greater than 1.8 wt %, greater than 1.9 wt %, or even greater than 2.0 wt %. The sulfur content of the resid base stock may also be less than or equal to each of the several values described above. For example, the sulfur content of the resid base stock may be less than 2.0 wt %, less than 1.5 wt %, less than 0.5 wt %, less than 0.25% or even less. To improve finished LSFO stability, about 5 to about 50 percent by volume of a residual cracked stock, such as decant oil (DCO) or slurry oil, is blended into the resid base stock. The decant oil tends to have a lower sulfur content than the resid base stock, and such sulfur content may be less than about 1.0 percent by weight, less than about 0.9 percent by weight, less than about 0.8 percent by weight, less than about 0.7 percent by weight, less than about 0.6 percent by weight, less than about 0.5 percent by weight, less than about 0.4 percent by weight, less than about 0.3 percent by weight, less than about 0.2 percent by weight, or even less than about 0.1 percent by weight. As described above, the synergistic effect of the decant oil and resid blend with respect to initial compatibility and/or longer term stability permits additional blending of up to about 75 percent by volume with low sulfur cutter stocks, such as light cycle oil (LCO), medium cycle oil (MCO), heavy cycle oil (HCO), and vacuum gas oil (VGO) cracked hydrocarbons or combinations thereof. These cracked hydrocarbons tend to be the lowest of the three blend components with respect to sulfur, and such sulfur content may less than about 0.1 percent by weight, less than about 0.15 percent by weight, less than about 0.20 percent by weight, less than about 0.25 percent by weight, less than about 0.30 percent by weight, less than about 0.40 percent by weight, less than about 0.45 percent by weight, or even less than about 0.50 percent by weight.

In one or more other such blends, about 12 to about 50 percent by volume of an atmospheric tower bottoms, vacuum tower bottoms, or a combination of both is utilized as a base stock. Again, to improve finished LSFO stability, about 16 to about 40 percent by volume of a residual cracked stock, such as decant oil or slurry oil, is blended into the resid base stock. The synergistic effect of the residual cracked stock (i.e., decant oil) and base stock resid blend permits additional blending of between about 25 to about 74 percent by volume of low sulfur cutter stocks, such as LCO, MCO, HCO, and VGO cracked hydrocarbons or combinations thereof, which may be paraffinic depending on the hydrocarbon fraction. In one or more embodiments of such blends, the blend characteristics may include one or more of the following: the kinematic viscosity is between about 50.1 and about 80.0 cSt, the API is between about 10.0 and about 18.9, the pour point is below 7° C. and the CCAI is greater than 810.

In one or more other such blends, about 15 percent to about 25 percent by volume of an atmospheric tower bottoms, vacuum tower bottoms, or combination of both is utilized as a base stock. Again, to improve finished LSFO stability, about 30 percent to about 45 percent by volume of residual cracked stock, such as a decant oil or slurry oil, is blended into the resid base stock. Thus, the ratio of the residual cracked stock (i.e., FCC cracked hydrocarbon products) to base stock resid may be 1.5 to 1 or even greater. Thus, more than 1.5, more than 1.6, more than 1.7, more than 1.8, more than 1.9 or even more than 2 times as much residual cracked stock may be used as compared to base stock resid. The synergistic effect of the residual cracked stock and base stock resid blend permits additional blending of between about 30 percent and about 50 percent by volume of low sulfur cutter stocks, such as LCO, MCO, HCO, and VGO cracked hydrocarbons or combination thereof, which may be paraffinic depending on the hydrocarbon fraction.

The utilization of vacuum tower bottoms (VTB) resid stock is enhanced if it is blended with decant oil (slurry oil) in sufficient volumetric proportions to create a synergistic blend. Thus, in one or more blend embodiments, initial compatibility and/or longer term stability are improved when VTB and decant oil (slurry) oil have a combined concentration of at least about 25 percent by volume of the final blend, with the remaining portion being composed of a cutter stock, such as light cycle oil, medium cycle oil, heavy cycle oil, vacuum gas oil, or combinations thereof. In one or more other embodiments, the combined concentration of VTB and decant oil is at least about 10 percent by volume, at least about 15 percent by volume, at least about 20 by volume, at least about 30 percent by volume, at least about 35 percent by volume, at least about 40 percent by volume, at least about 45 percent by volume, at least about 50 percent by volume, at least about 55 percent by volume, at least about 60 percent by volume, at least about 65 percent by volume, at least about 70 percent by volume, at least about 75 percent by volume, at least about 80 percent by volume, at least about 85 percent by volume, at least about 90 by volume, at least about 95 percent by volume, with the remaining portion in each case being composed of a cutter stock, such as light cycle oil, medium cycle oil, heavy cycle oil, vacuum gas oil, or combinations thereof, or other hydrocarbon fractions or additives, as known by those skilling the art. In at least one embodiment, the final blend comprises mainly vacuum tower bottoms and decant oil.

The utilization of atmospheric tower bottoms (ATB) in combination with VTB, or the utilization of ATB resid stock alone, is enhanced if these resid stocks are blended with decant oil (slurry oil) in sufficient volumetric proportions to create a synergistic blend. Thus, in one or more blend embodiments, initial compatibility and/or longer term stability are improved when ATB, VTB, and decant oil (slurry oil), or ATB and decant oil, have a combined concentration of at least 50 percent by volume of the final blend, with the remaining portion being composed of a cutter stock, such as light cycle oil, medium cycle oil, heavy cycle oil, vacuum gas oil, or combinations thereof. In one or more other embodiments, the combined concentration of ATB, VTB, and decant oil, or ATB and decant oil, is at least about 10 percent by volume, at least about 15 percent by volume, at least about 20 percent by volume, at least about 25 percent by volume, at least about 30 percent by volume, at least about 35 percent by volume, at least about 40 percent by volume, at least about 45 percent by volume, at least about 55 percent by volume, at least about 60 percent by volume, at least about 65 percent by volume, at least about 70 percent by volume, at least about 75 percent by volume, at least about 80 percent by volume, at least about 85 percent by volume, at least about 90 by volume, at least about 95 percent by volume, with the remaining portion in each case being composed of a cutter stock, such as light cycle oil, medium cycle oil, heavy cycle oil, vacuum gas oil, or combinations thereof, or other hydrocarbon fractions or additives, as known by those skilled in the art. In at least one embodiment, the final blend comprises mainly atmospheric tower bottoms and decant oil.

In one or more embodiments, the stability of the blend is further enhanced by the addition of two or more cutter stocks in combination. In such embodiments, the blend includes between about 15 percent to about 25 percent by volume of a base stock that is an atmospheric tower bottoms, vacuum tower bottoms, or a combination of both. To increase the stability of the resid base stock, between about 20 percent to about 40 percent by volume of a residual cracked stock, such as decant oil or slurry oil, is blended into the resid base stock. Thus, the ratio of the residual cracked stock (i.e., FCC cracked hydrocarbon products) to resid may be 1.5 to 1 or even greater. Thus, more than 1.5, more than 1.6, more than 1.7, more than 1.8, more than 1.9 or even more than 2 times as much residual cracked stock may be used as compared to resid. As previously mentioned, the synergistic effect of the decant/slurry oil and resid blend permits additional blending of between about 40 to about 65 percent by volume of more paraffinic, but lower sulfur cutter stocks, such as VGO, low sulfur VGO or combinations thereof. The blending of lower sulfur cutter stocks ensures that the final LSFO blend that includes the resid base stock and the decant/slurry oil will meet the required lower sulfur specification. However, in one or more embodiments, it has been found that adding LCO that is high in aromatic content in addition to VGO may enhance stability of the overall four component blend. Such added LCO may be in an amount of between about 0 percent by volume to about 15 percent by volume, which is equal to or less than the amount of VGO/LSVGO added to the blend. In one or more embodiments of such blends, the blend characteristics may include one or more of the following: the kinematic viscosity is between about 5 and about 20 cSt, the API is between about 10 and about 16, the flash point is below about 140° C. and the CCAI is greater than about 830.

TABLE III below gives the characteristics of several blend components, e.g., various VTB resids, decant/slurry oil, DGO, and LCO used in the several prophetic examples of final four-component blends (i.e., Blend A to Blend E) according to the disclosure herein. TABLE IV below gives the final blend compositions and the resulting characteristics for these several prophetic examples. In each of Blend A to Blend E, the four components blended as shown create a stable mixture in which the aged sediment is calculated below 0.1%.

TABLE III

| | Blend Component | | | | | |
|---|---|---|---|---|---|---|
| | Resid A | Resid B | Resid C | DCO/Slurry | DGO | LCO |
| SPG @ ~15° C. | 0.99 | 0.98 | 1.03 | 1.08 | 0.90 | 0.93 |
| Viscocisty @ ~50° C. (cSt) | 355.43 | 2234.82 | 8358.95 | 189.68 | 23.35 | 2.12 |
| Sulfur (wt %) | 2.51 | 0.42 | 0.54 | 0.30 | 0.05 | 0.05 |
| Pour Point (° C.) | | | | −1 | 24 | |
| Flash Point (° C.) | 82.5 | 83.5 | | 109.5 | 159 | 57.5 |
| API Gravity @ ~60° F. | 11.9 | 12.9 | 5.4 | −0.3 | 25.3 | 20.7 |
| Heptane Insolubles | 8.78 | | | 0.29 | 0.17 | |
| Saturates | 15.7 | 13.29 | 12.81 | 10.05 | 56.12 | 16.67 |
| Aromatics | 50.06 | 54.1 | 49.25 | 85.45 | 41.85 | 83.32 |
| Resins | 20.88 | 22.1 | 26.95 | 2.4 | 0.53 | 0 |
| Asphaltenes | 13.34 | 10.5 | 10.99 | 1.1 | 0 | 0 |
| CII | 0.41 | 0.31 | 0.31 | 0.13 | 1.32 | 0.20 |
| Solubility $S_{BN}$ | | | | 176 | 44 | |
| Insolubility $I_N$ | | | | 69 | 0 | |

TABLE IV

| | Blend A | Blend B | Blend C | Blend D | Blend E |
|---|---|---|---|---|---|
| Resid A | 0 | 0 | 0 | 0 | 10.37 |
| Resid B | 55.23 | 0 | 0 | 0 | 0 |
| Resid C | 0 | 14.59 | 19.79 | 20.45 | 0 |
| DCO/slurry | 24.74 | 21.92 | 35.18 | 34.59 | 27.59 |
| DGO | 17.08 | 61.40 | 40.36 | 40.17 | 60.00 |
| LCO | 2.96 | 2.09 | 4.67 | 4.78 | 2.04 |
| API Gravity @ ~60° F. | 11.47 | 15.77 | 12.96 | 11.21 | 15.82 |
| Density @ ~15° C. (g/ml) | 0.96 | 0.95 | 0.96 | 0.98 | 0.95 |
| Viscosity @ ~50° C. (cSt) | 17.54 | 10.86 | 6.92 | 7.56 | 9.59 |
| Sulfur (wt %) | 0.32 | 0.19 | 0.40 | 0.25 | 0.39 |
| Water by Distillation (vol %) | 0.04 | 0.04 | 0.04 | 0.04 | 0.04 |
| Flash Point (° C.) | 102.06 | 122.84 | 124.97 | 104.50 | 135.34 |
| Pour Point (° C.) | 0 | 0 | 0 | 0 | 0 |
| Potential Total Sediment (wt %) | <0.01 | <0.01 | <0.01 | <0.01 | 0.06 |
| Ash Content (wt %) | 0 | 0 | 0 | 0 | 0 |
| Vanadium (wppm) | 9.14 | 0.19 | 14.71 | 0.19 | 18.00 |
| Sodium (wppm) | 6.36 | 0.84 | 2.52 | 0.79 | 2.61 |
| Aluminum + Silicon (wppm) | 5.55 | 5.50 | 13.42 | 7.89 | 6.76 |
| Copper (wppm) | 0.30 | 0.25 | 0.30 | 0.24 | 0.31 |
| Calcium (wppm) | 3.38 | 0.17 | 0.72 | 0.16 | 0.99 |
| Zinc (wppm) | 0.57 | 0.24 | 0.33 | 0.16 | 0.56 |
| Phosphorus (wppm) | 1.43 | 0.84 | 1.09 | 0.79 | 1.16 |
| Nickel (wppm) | 8.95 | 0.26 | 6.91 | 0.24 | 7.48 |
| Iron (wppm) | 10.59 | 0.22 | 1.64 | 0.23 | 3.58 |
| Micro Carbon Residue (wt %) | 10.76 | 1.19 | 5.00 | 1.81 | 3.01 |
| Total Acid Number (mg KOH/ | 0.12 | 0.04 | 0.10 | 0.04 | 0.10 |
| CCAI | 830.64 | 834.94 | 847.49 | 853.99 | 841.57 |
| Saturates | 0.20 | 0.37 | 0.28 | 0.27 | 0.37 |
| Aromatics | 0.64 | 0.56 | 0.63 | 0.62 | 0.59 |
| Resins | 0.20 | 0.05 | 0.09 | 0.08 | 0.07 |
| Asphaltenes | 0.11 | 0.04 | 0.04 | 0.06 | 0.04 |
| CII | 0.38 | 0.66 | 0.44 | 0.47 | 0.62 |
| Solubility Index $S_{BN}$ | | | | | |
| Insolubility Index $I_N$ | 69 | 69 | 69 | 69 | 69 |

Figure 6:
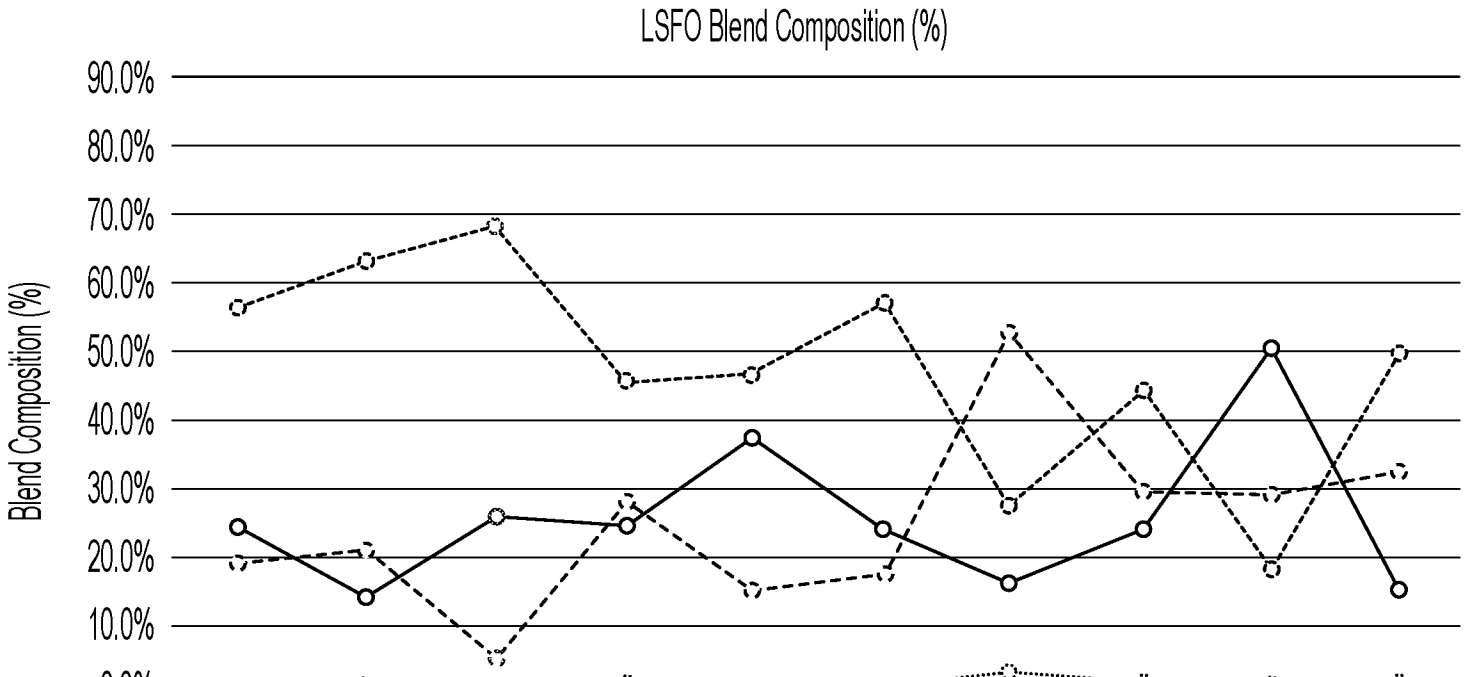
FIG. 6 is a plot showing various four-component blends, according to one or more embodiments of the disclosure.

FIG. 6 is a plot that illustrates several four-component blends, according to one or more embodiments of the disclosure. Each of the four-component blends is plotted along the x-axis with the specific percentages of the component listed in the table therebelow. The y-axis provides the blend composition of each component as a volume percent. Each of the blends contain a DCO (decant oil), HSFO (high sulfur fuel oil), LSVGO (low sulfur vacuum gas oil) and LCO (light cycle oil). The HSFO is derived from vacuum resid. As can be understood from FIG. 6, the ratios of the DCO to HSFO and LSVGO are similar to the three component blends described above. The added LCO has been added in low amounts to the overall blend such that the volume percent of light cycle oil is between about 0% to about 3.4%.

The use of three or more component blends also provides some flexibility regarding other desired or required blend properties. For example, and to limit the scope in any way, the decant/slurry oil may be blended with a greater amount of a heavy resid such that the resulting decant/resid blend is too heavy and would not meet the density specification of the final blend without additional components. A VGO or other sweet hydrocarbon fraction may be blended with the decant/resid to bring the sulfur of the resulting blend into specification. Moreover, a lighter distillate, such as kerosene, diesel, etc., may then be added to three-component blend of resid/decant/VGO to bring the density of the resulting and final four-component blend into specification. Thus, as described herein, the use of four components permits the utilization of a greater amount of resid while still providing a final blend that meets sulfur and density specifications.

Figure 7:
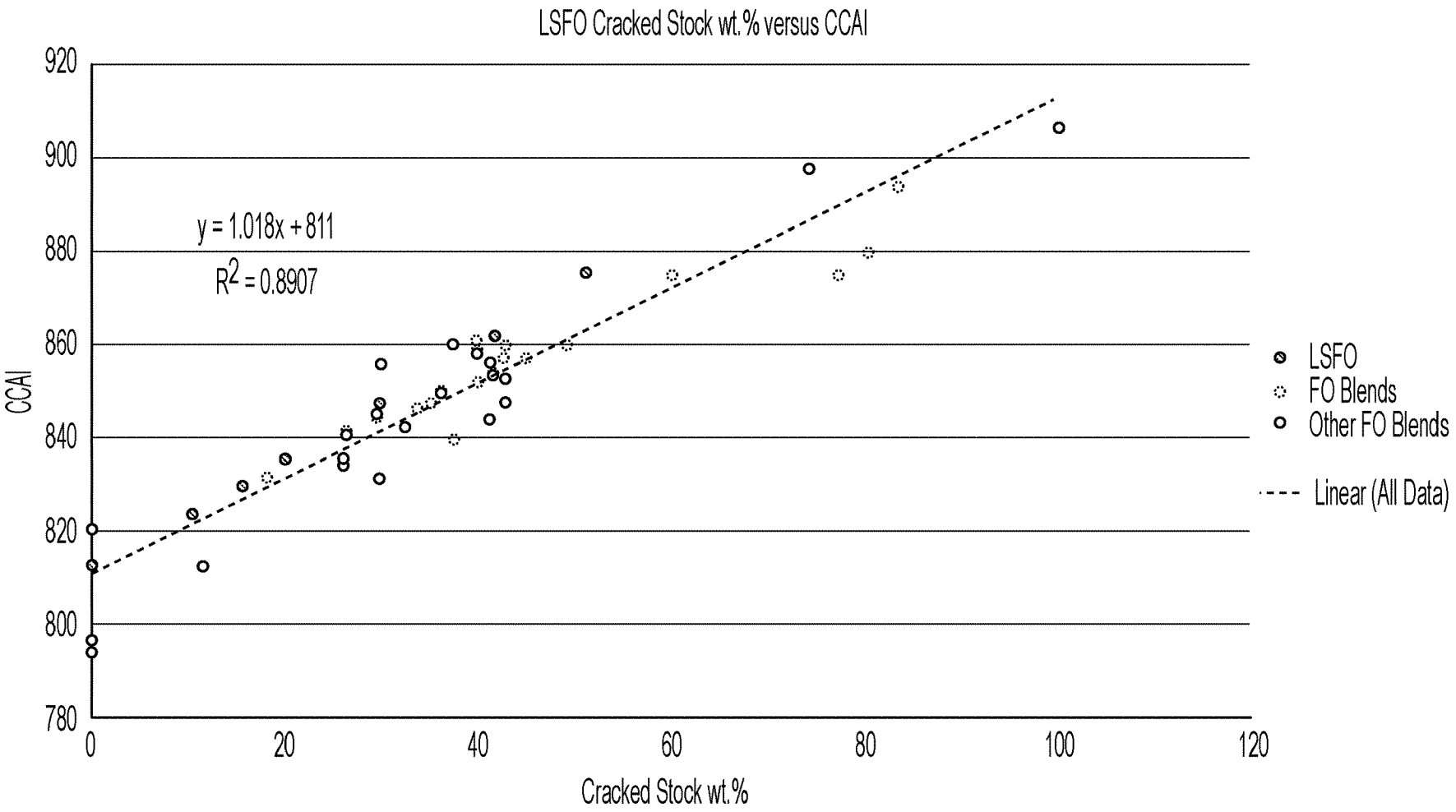
FIG. 7 is a plot of CCAI versus percent of cracked stock for various fuel oil blends, according to one or more embodiments of the disclosure.

FIG. 7 gives a plot of CCAI values versus cracked stock weight percent for several fuel oil blends, including low sulfur fuel oil blends. The cracked stock weight percent is the weight percent of cracked stock products (e.g., decant oil, HCO, MCO, LCO, etc.) from a fluid catalytic cracker that are added to the fuel oil blend. CCAI (calculated carbon aromaticity index) is an index of the ignition quality of residual fuel oil. Under the IMO 2020 specifications, the maximum CCAI is 870. The CCAI of fuel oils ranges from 800 to 880, with CCAI values between 810 to 860 being preferred. Several data points for fuel oils were plotted on FIG. 7, including LSFO blends (LSFO), fuel oil blends for fuel oil blend components available at a particular refinery (FO Blends), and other fuel oil blends (Other FO Blends). This plot of CCAI values versus cracked stock weight percent for these several fuel oil blends provides a near linear slope, as shown by the dotted line in FIG. 7, with the slope intersecting the y-axis at a CCAI of about 811 (e.g., close to the minimum CCAI for fuel oils). The near linear slope of the plot of FIG. 7 is indicative of a strong correlation between CCAI and the crack stock weight percent of cracked stock from the FCC unit. Based on the slope of this plot, the CCAI values increase in about a one to one ratio with the cracked stock weight percent. Thus, as the cracked stock in the fuel oil blend increases by one weight percent, the corresponding CCAI value also increases by one. Indeed, the maximum CCAI value of 870 for a low sulfur fuel oil under IMO2020 occurs when the cracked stock weight percentage of FCC cracked stock products approaches between about 58% and about 60%. Thus, in one or more embodiments, cracked stock added to the blend from the FCC unit (e.g., decant oil, light cycle oil, etc.) does not exceed about 60% of the blend. In other words, the FCC cracked stock products contribute less than about 58%, less than about 59% or even less than about 60% of the cracked stock to the low sulfur marine bunker fuel oil. In at least one embodiment, the low sulfur cutter stocks from the FCC unit contribute between about 30 wt % and about 50 wt % of cracked stock to the low sulfur marine bunker fuel oil such that the CCAI of the low sulfur marine bunker fuel oil is maintained between about 840 and about 860.

Example 1

In a first non-limiting, prophetic example of the above-described blending to achieve LSFO that meets specification under ISO 2020, a vacuum tower resid (RESID), a decant oil (DECANT) and a vacuum gas oil (VGO) were blended such that the final blend had 22.6% by volume of RESID, 14.3% by volume of DECANT, and 63.1% by volume of VGO. TABLE V gives the characteristics of the RESID, DECANT, VGO and the final blend. The combination of VTB and Decant was 36.9% by volume. The data provided in TABLE V for each of the RESID, DECANT, and VGO is based upon a certified analysis of each respective blend component that was performed by a third party analyzer. The data for the final blend (BLEND) given in TABLE V is based on a certified analysis of a hand blend that was also performed by the third party analyzer. Based on the characteristics thereof given in the far right column of TABLE V, the BLEND meets the marine bunker fuel oil specifications under IMO 2020, including the total sulfur content, which is below 0.5% at about 0.41% by weight. The BLEND also has a total aged sediment of less than 0.10 weight percent, which is indicative of longer term stability. As given in TABLE V, the BLEND also has an aromatics content of about 46% as well as a combined aluminum and silicon concentration of about 30 ppm. The solubility index is typically used to assess crude oil blending compatibility/stability, however, the solubility index has also proven useful when assessing the compatibility/stability of blending refined product. As with crude oil, refined product blends are typically compatible/stable when the solubility coefficient SBN of the blend is greater than the highest insolubility coefficient IN of any blend coefficient. Here, the BLEND has a solubility coefficient SBN of 85.3, which is higher than the highest insolubility index of any blend component (i.e., 69 for the DECANT). Thus, the solubility index confirms that compatibility and stability of the instant LSFO blend.

TABLE V

| | | BLEND COMPONENT | | | |
|---|---|---|---|---|---|
| Test Method | Characteristic | RESID | DECANT | VGO | BLEND |
| ASTM D4052 | API Gravity @ 60° F. | 12.5 | −0.3 | 22.4 | 17.4 |
| ASTM D445 | Test Temperature ° C. | 50.0 | 50.0 | 50.0 | 50 |
| | Kinematic Viscosity, cST | 108.9 | 109.8 | 26.87 | 27.6 |
| ASTM D97 | Pour Point, ° C. | −18 | 0 | 30 | −9 |
| ASTM D4530 | Carbon Residue, wt % | 7.28 | 4.75 | | 2.57 |
| | Micro Carbon Residue, wt % | 7.28 | 4.75 | <0.1 | 2.57 |
| ASTM D5762 | Nitrogen, ppm | 2758 | 1428 | | 1139 |
| IP 501 | Vanadium, ppm | 42 | <1 | | 9.6 |
| | Sodium, ppm | 13 | <1 | | 1.3 |
| | Aluminum, ppm | 12 | 6 | | 14.2 |
| | Silicon, ppm | 14 | 14 | | 15.8 |
| | Aluminum + Silicon | 26 | 20 | | 30 |
| | Iron | 26 | 1 | | 6.8 |
| | Nickel | 17 | <1 | | 3.9 |
| | Copper | 0.2 | <0.1 | | <1 |
| ASTM D4294 | Sulfur Content, wt % | 1.93 | 0.382 | 0.104 | 0.178 |
| ASTM D6560 | Asphaltenes, wt % | 2.3 | 0.5 | | 0.8 |
| ASTM D6379 | Total Aromatics, wt % | 38.9 | 63.7 | | 46.1 |
| ASTM D1160 | AET at IBP, ° F. | 367 | 431 | 454.9 | 173 |
| | AET at 5% Recovered, ° F. | 474 | 585 | 573 | 261 |
| | AET at 10% Recovered, ° F. | 514 | 657 | 617 | 304 |
| | AET at 20% Recovered, ° F. | 569 | 705 | 677 | 345 |
| | AET at 30% Recovered, ° F. | 627 | 732 | 719 | 373 |
| | AET at 40% Recovered, ° F. | 705 | 752 | 754 | 394 |
| | AET at 50% Recovered, ° F. | | 768 | 786 | 413 |
| | AET at 60% Recovered, ° F. | | 787 | 817 | 433 |
| | AET at 70% Recovered, ° F. | | 817 | 847 | 457 |
| | AET at 80% Recovered, ° F. | | 850 | 884 | 490 |
| | AET at 90% Recovered, ° F. | | 915 | 934 | 502 |
| | AET at 95% Recovered, ° F. | | | 971 | |
| | AET at 98% Recovered, ° F. | | | 1014 | |
| | AET at EP, ° F. | 705 | 957 | 1066.3 | |
| | Special Observation | cracking, 389 F. | cracking, 599 F. | | max T @ 90% |
| | Recovery, vol % | 41 | 93 | 100 | |
| | Residue, vol % | 59 | 7 | | |
| | Cold Trap Recovery, vol % | 0 | 0 | | |
| | Loss, vol % | 0 | 0 | | |
| ASTM D5705 | Test Temperature ° C. | 60 | | | 60 |
| | Hydrogen Sulfide in Vapor, ppm | 12 | | | 12.43 |

In one or more methods of blending the marine bunker fuel oil compositions disclosed herein, lower economic value resid base stock is used to as great an extent as possible because of its economic advantage when used in LSFO. LSFO is generally sold on the basis of weight; therefore, LSFO having denser hydrocarbon components provide greater economic return on a volume basis. However, the resid base stocks tend to be high in sulfur content and in viscosity, both of which have lower limits under IMO 2020 (see ISO 8217, RMG 380). In one or more embodiments, the method optimizes the amount of resid stock, but uses a quantity of decant oil, e.g., from about 16% to about 40% by volume, to stabilize the resid base stock such that a low sulfur cutter stock, such as cycle oil or vacuum gas oil, may be used to reduce viscosity and sulfur to meet specification in the final blend. In effect, the cracked stocks, such as decant oil (slurry oil), are used as compatibility and/or stability enhancers for the residual hydrocarbon base. This creates robust blending opportunities to achieve final fuel blends having higher density but also having initial compatibility and longer term stability (e.g., reducing asphaltene precipitation). Here, the use of low sulfur decant oil from hydrotreated FCC feeds also works to reduce sulfur content of the blend thereby reducing the amount of economically more expensive low sulfur distillate or low sulfur hydrocarbon that will be required to meet the final blend specification.

In one or more methods of blending the LSFO, a resid feed stock, such as vacuum tower bottoms, is produced. This short resid has a sulfur content of at least about 1.5 percent by weight. Optionally, the bottoms from the fluidized catalytic cracker (FCC) unit, i.e., decant oil (slurry oil), is filtered or decanted to remove FCC catalyst fines concentration, (e.g., aluminum, silicon, etc.) thereby reducing the concentration of aluminum and/or silicon in the filtered or decanted oil. Such additional filtering and/or decanting facilitates the achievement of the maximum combined aluminum and silicon concentration in the final blend. The decant oil is produced in a fluid catalytic cracker using a hydrotreated feed that is fed to the fluid catalytic cracker. The resulting low sulfur decant oil, having a sulfur content of less than about 1.2 percent by weight, less than about 1.0 percent by weight, less than about 0.8 percent by weight, less than about 0.6 percent by weight, less than 0.4 percent by weight or even less than 0.2 percent by weight, is either blended with the resid feed stock or added into a tank holding the resid feed stock. The blended resid feed stock is held in a tank until further blending with the cutter stocks to create the final blend. The decant oil mitigates the paraffin nature of cutter stocks to enhance the compatibility of the cutter stocks in the final blend. A cutter stock, such as a LCO, MCO, HCO, and/or VGO, having a sulfur content of less than about 0.5 percent by weight, less than about 0.4 percent by weight, less than about 0.3 percent by weight, less than about 0.2 percent by weight, or even less than about 0.1 percent by weight, is then either blended with the resid base stock and decant oil or added into a tank holding the resid base stock and decant oil. The cutter stock reduces the final blend sulfur content to less than 0.5 percent by weight and facilitates meeting the other final fuel specifications, e.g., viscosity, etc., as will be understood by those skilled in the art.

TABLE VI below gives the characteristics of several blend components, e.g., various resids, decant oil, LCO, HCO and VGO, used in the several prophetic examples of final blends (i.e., Blend 1 to Blend 14) according to the disclosure herein. TABLE VII below gives the final blend compositions for the several prophetic examples of such final blends according to the disclosure herein. TABLES VIII and IX provide the characteristics for the several prophetic examples of such final blends having the corresponding final blend compositions given in TABLE VII and that use various blend components, whose characteristics are given in TABLE VI. Within TABLES VIII and IX, the values in bold italics represent characteristics of the respective final blend that do not meet the specifications required under IMO 2020 (see ISO 8217, RMG 380). However, with slight adjustments to the blend component concentrations, these blends could be brought to within specification under IMO 2020.

TABLE VI

| Test | | Blend Components | | | | | | | | |
|---|---|---|---|---|---|---|---|---|---|---|
| Method | Characteristic | Resid 1 | Resid 2 | Resid 3 | Resid 4 | Resid 5 | Decant Oil | VGO | LCO | HCO |
| | API Gravity @ ~60° F. | 5.8 | 11.9 | 12.9 | 14.3 | 13.9 | −0.3 | 25.3 | 39.0 | 39.0 |
| | Density @ ~15° C. (g/ml) | 0.999 | 0.987 | 0.949 | 0.939 | 0.960 | 1.049 | 0.900 | 0.830 | 0.830 |
| | Viscocisty @ ~50° C. (cSt) | 473.78 | 355.43 | 2234.82 | 888.93 | 10116.20 | 189.68 | 23.35 | 5.00 | 35.06 |
| | Sulfur (wt %) | 1.74 | 2.51 | 0.42 | 1.38 | 1.59 | 0.30 | 0.05 | 0.05 | 0.17 |
| | Flash Point (° C.) | 178.0 | | | 99.0 | 132.0 | 109.5 | 159.0 | 57.5 | 60.5 |
| | Pour Point (° C.) | | | | 53.6 | | 35.0 | 24.0 | | |
| | Potential Total Sediment (wt %) | | | | | | | | | |
| | Ash Content (wt %) | 10 | | | | | | | | |
| | Vanadium (wppm) | 42.8 | 167.0 | 16.5 | 71.8 | 93.1 | 0.3 | 0.2 | 0.2 | 0.2 |
| | Sodium (wppm) | 9.4 | 16.1 | 10.8 | 7.6 | 1.1 | 1.0 | 1.0 | 1.0 | 1.0 |
| | Aluminum + Silicon (wppm) | | | | 27 | 40 | 20 | 1 | | |
| | Copper (wppm) | 0.3 | 0.4 | 0.3 | 0.5 | 0.3 | 0.3 | 0.3 | 0.3 | 0.3 |
| | Calcium (wppm) | 4.69 | 7.64 | 6.02 | 2.77 | 5.74 | 0.20 | 0.20 | 0.20 | 0.20 |
| | Zinc (wppm) | 1.24 | 3.11 | 0.91 | 1.02 | 2.31 | | 0.40 | 0.40 | 0.40 |
| | Phosphorus (wppm) | 1.16 | 2.53 | 1.79 | 1.35 | 2.45 | 1.00 | 1.00 | 1.00 | 1.00 |
| | Nickel (wppm) | 31.7 | 67.6 | 16.1 | 33.3 | 37.5 | 0.3 | 0.3 | 0.3 | 0.3 |
| | Iron (wppm) | 55 | 31.4 | 19.1 | 7.04 | 20.7 | 0.40 | 0.20 | 0.20 | 0.21 |
| | Micro Carbon Residue (wt %) | 17.16 | 14.25 | 17.32 | 15.57 | 12.3 | 4.73 | 0.04 | 0.27 | 0.76 |
| | Total Acid Number (mg KOH/kg) | 0.10 | 0.76 | 0.19 | 0.18 | 0.32 | 0.03 | 0.02 | 0.01 | 0.03 |
| | Saturates | 10.38 | 15.7 | 15.05 | 13.29 | 28.52 | 10.05 | 56.12 | 11.21 | 22.09 |
| | Aromatics | 70.16 | 50.06 | 55.13 | 54.10 | 47.43 | 86.45 | 41.85 | 88.78 | 72.08 |
| | Resins | 10.32 | 20.88 | 18.57 | 22.1 | 13.09 | 2.40 | 0.53 | 0 | 1.77 |
| | Aspaltenes | 9.12 | 13.3 | 11.2 | 10.5 | 10.9 | 1.1 | 0 | 0 | 4.1 |
| | CII | 0.242 | 0.409 | 0.357 | 0.312 | 0.652 | 0.125 | 1.324 | 0.126 | 0.354 |
| | Heptane Insolubles | 6.42 | 8.78 | | 8.55 | 2.43 | 0.29 | 0.17 | | |

TABLE VII

| | Blend Compositions | | | | | | |
|---|---|---|---|---|---|---|---|
| | Bind #1 | Bind #2 | Bind #3 | Bind #4 | Bind #5 | Bind #6 | Bind #7 |
| Component | | | | | | | |
| Resid 1 | | | 12.02 | | | | 23.28 |
| Resid 2 | | 12.84 | | | | | |
| Resid 3 | | | | 25.50 | | | |
| Resid 4 | 24.81 | | | | 23.36 | | |
| Resid 5 | | | | | | 24.59 | |
| Decant Oil | 30.66 | 40.32 | 53.94 | 36.94 | 50.23 | 47.02 | 13.59 |
| Vacuum Gas Oil | 44.53 | 46.84 | | 37.56 | | | 63.12 |
| Light Cycle Oil | | | 34.05 | | 26.42 | | |
| Heavy Cycle Oil | | | | | | 28.38 | |

| | Blend Compositions | | | | | | |
|---|---|---|---|---|---|---|---|
| | Bind #8 | Bind #9 | Bind #10 | Bind #11 | Bind #12 | Bind #13 | Bind #14 |
| Component | | | | | | | |
| Resid 1 | 24.71 | | | | | | |
| Resid 2 | | | | | | | 23.81 |
| Resid 3 | | 26.29 | 25.50 | 22.42 | | | |
| Resid 4 | | | | | 25.89 | 25.51 | |
| Resid 5 | | | | | | | |
| Decant Oil | 42.35 | 57.12 | 36.94 | 16.24 | 41.76 | 32.00 | 13.70 |
| Vacuum Gas Oil | 32.95 | 16.59 | 37.56 | 61.33 | 32.35 | 42.49 | 62.49 |
| Light Cycle Oil | | | | | | | |
| Heavy Cycle Oil | | | | | | | |

Example 2

In non-limiting, prophetic Example 2, Blend #1 is composed of Resid 4, a sweet run vacuum tower bottom blend, to which Decant Oil and Vacuum Gas Oil have been added. The final blend has about 24.8 percent by volume Resid 4, 30.7 percent by volume Decant Oil, and 55.5 percent by volume Vacuum Gas Oil. The characteristics of the Resid 4, Decant Oil, and Light Cycle Oil are given in TABLE VI. The final blend, Blend #1, has the characteristics given in TABLE VIII and is projected to meet the marine bunker fuel oil specifications under IMO 2020, including the total sulfur content, which is below 0.5% at about 0.46% by weight. Blend #1 is also calculated to meet the total aged sediment requirement of less than 0.10 weight percent, which is indicative of longer term stability. As given in TABLE VIII, Blend #1 has an aromatics content of about 61%. Blend #1 also has a combined volume of vacuum tower bottoms and decant oil that is higher than 50%—at about 55.5%.

Example 3

In non-limiting, prophetic Example 3, Blend #3 is composed of Resid 1, a severely cracked vacuum tower bottoms, to which Decant Oil and then Light Cycle Oil have been added. The final blend has about 12 percent by volume of Resid 1, about 54 percent by volume of Decant Oil and about 34 percent by volume of Light Cycle Oil. The characteristics of the Resid 1, Decant Oil, and Light Cycle Oil are given in TABLE VI. The final blend, Blend #3, has the characteristics given in TABLE VIII and is projected to meet the marine bunker fuel oil specifications under IMO 2020, including the total sulfur content, which is below 0.5% at about 0.41% by weight. Blend #3 is also calculated to meet the total aged sediment requirement of less than 0.10 weight percent, which is indicative of longer term stability. As given in TABLE VIII, Blend #3 has an aromatics content of about 88%. In one or more embodiments, the total aromatics content of the final blend is at most 90%, at most 85% at most 80%, at most 75%, at most 70%, at most 65%, at most 60%, or even at most 55%, in order to mitigate and/or control particulate emissions upon combustion of the LSFO. Blend #3 also has a combined volume of vacuum tower bottoms and decant oil that is higher than 50%—at about 66%.

Example 4

In non-limiting, prophetic Example 4, Blend #10 is composed of Resid 3, a mildly cracked sweet run vacuum tower bottom blend, to which Decant Oil and then Vacuum Gas Oil have been added. The final blend has about 25.5 percent by volume of Resid 3, about 36.9 percent by volume of Decant Oil and about 37.6 percent by volume of Vacuum Gas Oil. The characteristics of the Resid 3, Decant Oil, and Vacuum Gas Oil are given in TABLE VI. The final blend, Blend #10, has the characteristics given in TABLE IX and is projected to meet the marine bunker fuel oil specifications under IMO 2020, including the total sulfur content, which is below 0.5% at about 0.24% by weight. Here, there is sulfur giveaway and possible room to increase the volume of the Resid 3, if the other IMO requirements of the final blend can be met. Blend #10 is also calculated to meet the total aged sediment requirement of less than 0.10 weight percent, which is indicative of longer term stability. As given in TABLE IX, Blend #3 has an aromatics content of about 64%. Blend #10 also has a combined volume of vacuum tower bottoms and decant oil that is higher than 50% at about 62.4%.

Although only Blend #1, Blend #3 and Blend #10 are discussed above in the Examples 2 through 4, respectively, each of Blends #1 through #14 of TABLE VII is a non-limiting example of the blend compositions and associated methods disclosed herein.

TABLE VIII

| Characteristic | Example Blends | | | | | | |
|---|---|---|---|---|---|---|---|
| | Blend 1 | Blend 2 | Blend 3 | Blend 4 | Blend 5 | Blend 6 | Blend 7 |
| API Gravity @ ~60° F. | 13.87 | 12.25 | 11.71 | 11.81 | 11.78 | 25.84 | 16.47 |
| Density @ ~15° C. (g/ml) | 0.96 | 0.97 | 0.97 | 0.97 | 0.96 | 0.90 | 0.94 |
| Viscocisty @ ~50° C. (cSt) | 39.91 | 31.32 | 99.69 | 60.10 | 129.26 | 33.29 | 25.05 |
| Sulfur (wt %) | 0.46 | 0.48 | 0.41 | 0.24 | 0.49 | 0.49 | 0.51 |
| Water by Distillation (vol %) | 0.00 | 0.00 | 0.00 | 0.00 | 0.00 | 0.00 | 0.00 |
| Flash Point (° C.) | 128.94 | 118.63 | 100.03 | 100.17 | 93.31 | 150.09 | 156.69 |
| Pour Point (° C.) | | | | | | | |
| Potential Total Sediment (wt %) | <0.01 | 0.02 | 0.02 | <0.01 | <0.01 | 0.04 | 0.54 |
| Ash Content (wt %) | 0.00 | 0.00 | 1.25 | 0.00 | 0.00 | 0.00 | 2.51 |
| Vanadium (wppm) | 17.94 | 21.71 | 5.59 | 4.36 | 16.68 | 24.92 | 10.90 |
| Sodium (wppm) | 2.63 | 2.94 | 2.05 | 3.48 | 2.51 | 1.03 | 3.11 |
| Aluminum + Silicon (wppm) | 13.88 | 9.26 | 11.77 | 8.41 | 17.17 | 11.11 | 3.66 |
| Copper (wppm) | 0.36 | 0.32 | 0.30 | 0.30 | 0.35 | 0.30 | 0.30 |
| Calcium (wppm) | 0.84 | 1.16 | 0.76 | 1.67 | 0.79 | 1.67 | 1.33 |
| Zinc (wppm) | 0.42 | 0.57 | 0.27 | 0.37 | 0.32 | 0.91 | 0.55 |
| Phosphorus (wppm) | 1.09 | 1.20 | 1.02 | 1.20 | 1.03 | 1.39 | 1.04 |
| Nickel (wppm) | 8.47 | 8.97 | 4.25 | 4.31 | 7.88 | 10.22 | 8.18 |
| Iron (wppm) | 1.96 | 4.30 | 7.18 | 5.06 | 1.88 | 5.66 | 13.98 |
| Micro Carbon Residue (wt %) | 5.47 | 3.94 | 5.01 | 6.31 | 6.23 | 3.49 | 5.05 |
| Total Acid Number (mg KOH/kg) | 0.06 | 0.12 | 0.03 | 0.07 | 0.06 | 0.10 | 0.04 |
| CCAI | 845.62 | 865.49 | 844.33 | 851.23 | 838.00 | 788.07 | 842.18 |
| Saturates | 0.30 | 0.31 | 0.10 | 0.27 | 0.11 | 0.40 | 0.38 |
| Aromatics | 0.60 | 0.62 | 0.85 | 0.63 | 0.80 | 0.51 | 0.56 |
| Resins | 0.06 | 0.04 | 0.03 | 0.06 | 0.06 | 0.04 | 0.03 |
| Asphaltenes | 0.03 | 0.02 | 0.02 | 0.03 | 0.03 | 0.04 | 0.02 |
| CII | 0.50 | 0.50 | 0.14 | 0.45 | 0.16 | 0.79 | 0.69 |
| Solubility Index $S_{BN}$ | | | | | | | |
| Insolubility Index $I_N$ | 69 | 69 | 69 | 69 | 69 | 69 | 69 |

TABLE IX

| Characteristic | Example Blends | | | | | | |
|---|---|---|---|---|---|---|---|
| | Blend 8 | Blend 9 | Blend 10 | Blend 11 | Blend 12 | Blend 13 | Blend 14 |
| API Gravity @ ~60° F. | 8.79 | 6.76 | 11.81 | 17.67 | 10.91 | 13.45 | 17.94 |
| Density @ ~15° C. (g/ml) | 0.99 | 1.00 | 0.97 | 0.94 | 0.97 | 0.96 | 0.94 |
| Viscocisty @ ~50° C. (cSt) | 46.73 | 97.42 | 60.10 | 31.04 | 58.11 | 41.99 | 23.91 |
| Sulfur (wt %) | 0.59 | 0.29 | 0.24 | 0.18 | 0.50 | 0.47 | 0.70 |
| Water by Distillation (vol %) | 0.00 | 0.00 | 0.00 | 0.00 | 0.00 | 0.00 | 0.05 |
| Flash Point (° C.) | 142.73 | 88.93 | 100.17 | 115.31 | 122.79 | 127.86 | 134.01 |
| Pour Point (° C.) | | | | | | | |
| Potential Total Sediment (wt %) | 0.10 | 0.02 | 0.02 | 0.02 | <0.01 | <0.01 | 0.06 |
| Ash Content (wt %) | 2.52 | 0.00 | 0.00 | 0.00 | 0.00 | 0.00 | 0.00 |
| Vanadium (wppm) | 10.99 | 4.36 | 4.36 | 3.99 | 18.35 | 18.39 | 41.61 |
| Sodium (wppm) | 3.12 | 3.47 | 3.48 | 3.27 | 2.67 | 2.67 | 4.75 |
| Aluminum + Silicon (wppm) | 9.35 | 12.18 | 8.41 | 4.28 | 16.19 | 14.31 | 3.72 |
| Copper (wppm) | 0.30 | 0.30 | 0.30 | 0.30 | 0.36 | 0.36 | 0.33 |
| Calcium (wppm) | 1.33 | 1.67 | 1.67 | 1.55 | 0.85 | 0.85 | 20.46 |
| Zinc (wppm) | 0.43 | 0.29 | 0.37 | 0.44 | 0.58 | 0.42 | 1.01 |
| Phosphorus (wppm) | 1.04 | 1.20 | 1.20 | 1.18 | 1.09 | 1.09 | 1.38 |
| Nickel (wppm) | 8.23 | 4.29 | 4.31 | 3.96 | 8.65 | 8.67 | 17.00 |
| Iron (wppm) | 14.12 | 5.08 | 5.06 | 4.62 | 2.02 | 2.00 | 7.97 |
| Micro Carbon Residue (wt %) | 6.48 | 7.21 | 6.31 | 4.91 | 6.09 | 5.64 | 4.30 |
| Total Acid Number (mg KOH/kg) | 0.04 | 0.07 | 0.07 | 0.06 | 0.06 | 0.06 | 0.02 |
| CCAI | 875.07 | 874.34 | 851.23 | 830.07 | 845.62 | 845.62 | 840.77 |
| Saturates | 0.24 | 0.18 | 0.27 | 0.38 | 0.25 | 0.29 | 0.39 |
| Aromatics | 0.69 | 0.72 | 0.63 | 0.53 | 0.65 | 0.61 | 0.51 |
| Resins | 0.38 | 0.06 | 0.06 | 0.05 | 0.07 | 0.07 | 0.06 |
| Asphaltenes | 0.03 | 0.03 | 0.03 | 0.03 | 0.09 | 0.03 | 0.03 |
| CII | 0.37 | 0.28 | 0.45 | 0.71 | 0.39 | 0.48 | 0.75 |
| Solubility Index $S_{BN}$ | | | | | | | |
| Insolubility Index $I_N$ | 69 | 69 | 69 | 69 | 69 | 69 | 69 |

As shown in the above Examples 1-4, the three component blends of a VTB (or ATB) blended with a decant oil (slurry oil) and a low sulfur cutter stock, such as VGO and/or cycle oil, in the appropriate blend ratios will meet the LSFO fuel specification IMO 2020 requirements (see ISO-8217, RMG-380). As described previously, these blend components are blended for their synergistic effect to stabilize the resid hydrocarbon fraction while permitting subsequent dilution with cutter stock to meet low sulfur and viscosity requirements, among others, of the finished blended product.

Example 5

In Example 5, an atmospheric tower bottoms, a decant/slurry oil, and a low sulfur vacuum gas oil were blended to achieve an LSFO marketed to meet the specification under ISO 2020 (see ISO 8217, RMG 380). TABLE X below gives the characteristics of each of the blend components used to create this blend.

TABLE X

| | BLEND COMPONENT | | |
|---|---|---|---|
| Characteristic | ATB | DCO | LSVGO |
| API Gravity @ 60° F. | 12.2 | −0.5 | 24.5 |
| SPG | 1.0 | 1.1 | 0.9 |
| Viscosity, cST | 2244 | 186 | 20.9 |
| Viscosity, Sfs | 1058.5 | 87.7 | 10.93 |
| Viscosity (calc) | 1.941 | 1.5 | 0.901 |
| Flash Point, ° C. | 110 | 76.7 | 82.2 |
| Pour Point, ° C. | 9 | 0 | 33 |
| Micro Carbon Residue, wt % | 16.5 | 4.3 | 0.1 |
| Vanadium, ppm | 72 | 2 | 1 |
| Sodium, ppm | 8 | 1 | 1 |
| Aluminum + Silicon | 15 | 220 | 4 |
| Sulfur Content, wt % | 1.74 | 0.34 | 0.04 |

To create the blend of Example 5, about 23.0 percent by volume of ATB, about 28.0 percent by volume of decant/slurry oil, and about 46.8 percent by volume of low sulfur vacuum gas oil were blended to achieve an LSFO achieving the IMO 2020 specification per ISO 8217. The characteristics of the final blend, which are based on a certified analysis, are given in TABLE XI below. It should be noted that the sulfur content of the final blend is about 0.299 percent by weight, which is less than the maximum allowable of 0.5 percent by weight. The potential total sediment (i.e., total sediment aged) of 0.01 weight percent is also well below the maximum allowable of 0.1 weight percent and its low value is indicative of a compatible and stable fuel oil blend. Here, the ATB and decant/slurry oil constitute about 51.0 percent by volume of the blend. The final blend has a solubility coefficient SBN of 148.9, which is much higher than 69, the highest insolubility index IN of any blend component. Thus, the solubility index confirms that compatibility and stability of the instant LSFO blend.

TABLE XI

| TEST METHOD | CHARACTERISTIC | BLEND |
|---|---|---|
| ASTM D4052 | API Gravity @ 60° F. | 14.8 |
| ASTM D445 | Viscosity, cST @ 50° C. | 35.41 |
| ASTM D93B | Flash Point, ° C. | 101.1 |
| ASTM D97 | Pour Point, ° C. | −9 |
| ASTM D4530 | Micro Carbon Residue, wt % | 1.67 |
| IP 501 | Vanadium, ppm | 11.5 |
| IP 501 | Sodium, ppm | 2.2 |
| IP 501 | Aluminum, ppm | 20.5 |
| IP 501 | Silicon, ppm | 23.8 |
| IP 501 | Aluminum + Silicon | 44.3 |
| IP 501 | Phosphorus | 0.8 |
| IP 501 | Iron | 2.9 |
| IP 501 | Zinc | 0.4 |
| IP 501 | Calcium | 0.9 |
| ASTM D664A | TAN Acidity, mgKOH/g | <0.10 |
| ASTM D482 | Ash, wt % | <0.010 |
| ASTM D4294 | Sulfur Content, wt % | 0.299 |
| ASTM D4870 | Accelerated Total Sediment, wt % | <0.01 |
| ASTM D4870 | Potential Total Sediment, wt % | 0.01 |
| Calc | CCAI | 859 |
| ASTM D4740 | Compatibility, D4740 | 2 |

TABLE XI-continued

| TEST METHOD | CHARACTERISTIC | BLEND |
|---|---|---|
| ASTM D95 | Water, vol % | 0.05 |
| ASTM D7061 | Separability Number, % | 0.1 |
| ASTM D7061 | Oil:Toluene Ratio, wt % | 1:09 |

Example 6

In Example 6, a vacuum tower bottoms, a decant/slurry oil, a low sulfur vacuum gas oil and a heel portion were blended to achieve an LSFO marketed to meet the specification under ISO 2020 (see ISO 8217, RMG 380). TABLE XII below gives the characteristics of each of the blend components used to create this blend.

TABLE XII

| | BLEND COMPONENT | | | |
|---|---|---|---|---|
| Characteristic | VTB | DCO | LSVGO | HEEL |
| API Gravity @ 60° F. | 15.6 | 0.5 | 25.2 | 14 |
| SPG | 0.962 | 1.072 | 0.903 | 0.973 |
| Viscosity, cST | 510 | 168 | 20.9 | 60 |
| Viscosity, Sfs | 240.6 | 79.2 | 10.93 | 28.3 |
| Viscosity (calc) | 1.702 | 1.478 | 0.901 | 1.215 |
| Flash Point, ° C. | 67.8 | 65.5 | 110 | 96.7 |
| Pour Point, ° C. | 9 | 0 | 30 | −9 |
| Micro Carbon Residue, wt % | 16.5 | 4.3 | 0.1 | 3.9 |
| Vanadium, ppm | 72 | 2 | 1 | 13 |
| Sodium, ppm | 8 | 1 | 1 | 3 |
| Aluminum + Silicon | 15 | 182 | 4 | 14 |
| Sulfur Content, wt % | 1.35 | 0.3 | 0.04 | 0.415 |

To create the blend of Example 6, about 23.6 percent by volume of VTB, about 19.7 percent by volume of decant/slurry oil, about 55.1 percent by volume of low sulfur vacuum gas oil and about 1.6% by volume of a heel portion were blended to achieve an LSFO achieving the IMO 2020 specification per ISO 8217. The characteristics of the final blend, which are based on a certified analysis, are given in TABLE XIII below. It should be noted that the sulfur content of the final blend is about 0.401 percent by weight, which is less than the maximum allowable of 0.5 percent by weight. The accelerated total sediment of 0.01 weight percent is also well below the maximum allowable of 0.1 weight percent and its low value is indicative of a compatible and stable fuel oil blend. Here, the VTB and decant/slurry oil constitute about 43.3 percent by volume of the blend.

TABLE XIII

| TEST METHOD | CHARACTERISTIC | BLEND |
|---|---|---|
| ASTM D4052 | API Gravity @ 60° F. | 16.9 |
| ASTM D445 | Viscosity, cST @ 50° C. | 62.51 |
| ASTM D93B | Flash Point, ° C. | 110 |
| ASTM D97 | Pour Point, ° C. | −9 |
| ASTM D4530 | Micro Carbon Residue, wt % | 2.54 |
| IP 501 | Vanadium, ppm | 19 |
| IP 501 | Sodium, ppm | 4 |
| IP 501 | Aluminum, ppm | 9 |
| IP 501 | Silicon, ppm | 2.4 |
| IP 501 | Aluminum + Silicon | 11.4 |
| IP 501 | Phosphorus | 0.1 |
| IP 501 | Iron | 4 |
| IP 501 | Zinc | 0.6 |
| IP 501 | Calcium | 1 |
| ASTM D664A | TAN Acidity, mgKOH/g | 0.17 |

TABLE XIII-continued

| TEST METHOD | CHARACTERISTIC | BLEND |
|---|---|---|
| ASTM D482 | Ash, wt % | 0.011 |
| ASTM D4294 | Sulfur Content, wt % | 0.401 |
| ASTM D4870 | Accelerated Total Sediment, wt % | 0.01 |
| Calc | CCAI | 836 |
| ASTM D4740 | Compatibility, D4740 | 1 |
| ASTM D95 | Water, vol % | 0.05 |

Example 7

In Example 7, a vacuum tower bottoms, a decant/slurry oil, a low sulfur vacuum gas oil and a heel portion were blended to achieve an LSFO marketed to meet the specification under ISO 2020 (see ISO 8217, RMG 380). TABLE XIV below gives the characteristics of each of the blend components used to create this blend.

TABLE XIV

| | BLEND COMPONENT | | | |
|---|---|---|---|---|
| Characteristic | VTB | DCO | LSVGO | HEEL |
| API Gravity @ 60° F. | 15 | 0.5 | 25.2 | 19.9 |
| SPG | 0.966 | 1.072 | 0.903 | 0.935 |
| Viscosity, cST | 510 | 168 | 24 | 51.1 |
| Viscosity, Sfs | 24.6 | 79.2 | 12.55 | 24.1 |
| Viscosity (calc) | 1.702 | 1.478 | 0.952 | 1.168 |
| Flash Point, ° C. | 67.8 | 65.5 | 110 | 84.7 |
| Pour Point, ° C. | 9 | 0 | 30 | 12 |
| Micro Carbon Residue, wt % | 16.5 | 4.3 | 0.1 | 3.7 |
| Vanadium, ppm | 72 | 2 | 1 | 21.2 |
| Sodium, ppm | 8 | 1 | 1 | 3 |
| Aluminum + Silicon | 15 | 4 | 4 | 28 |
| Sulfur Content, wt % | 1.3 | 0.347 | 0.04 | 0.427 |

To create the blend of Example 7, about 16.7 percent by volume of VTB, about 34.4 percent by volume of decant/slurry oil, about 25.6 percent by volume of low sulfur vacuum gas oil and about 23.3% by volume of a heel portion were blended to achieve an LSFO achieving the IMO 2020 specification per ISO 8217. The characteristics of the final blend, which are based on a certified analysis, are given in TABLE XV below. It should be noted that the sulfur content of the final blend is about 0.49 percent by weight, which is just less than the maximum allowable of 0.5 percent by weight. The potential total sediment (i.e., total sediment aged) of <0.01 weight percent is also well below the maximum allowable of 0.1 weight percent and its low value is indicative of a compatible and stable fuel oil blend. Here, the VTB and decant/slurry oil constitute about 51.1 percent by volume of the blend.

TABLE XV

| TEST METHOD | CHARACTERISTIC | BLEND |
|---|---|---|
| ASTM D4052 | API Gravity @ 60° F. | 11.9 |
| ASTM D445 | Viscosity, cST @ 50° C. | 77.86 |
| ASTM D93B | Flash Point, ° C. | 85 |
| ASTM D97 | Pour Point, ° C. | −12 |
| ASTM D4530 | Micro Carbon Residue, wt % | 3.76 |
| IP 501 | Vanadium, ppm | 18 |
| IP 501 | Sodium, ppm | 14 |
| IP 501 | Aluminum, ppm | 13 |
| IP 501 | Silicon, ppm | 10 |
| IP 501 | Aluminum + Silicon | 23 |
| IP 501 | Phosphorus | 0.3 |
| IP 501 | Zinc | 0.2 |
| IP 501 | Calcium | 0.8 |
| ASTM D664A | TAN Acidity, mgKOH/g | 0.15 |
| ASTM D482 | Ash, wt % | 0.011 |
| ASTM D4294 | Sulfur Content, wt % | 0.49 |
| ASTM D4870 | Accelerated Total Sediment, wt % | 0.01 |
| ASTM D4870 | Potential Total Sediment, wt % | <0.01 |
| Calc | CCAI | 866 |
| ASTM D4740 | Compatibility, D4740 | 1 |
| ASTM D95 | Water, vol % | 0.1 |
| ASTM D7061 | Separability Number, % | 0.5 |
| ASTM D7061 | Oil:Toluene Ratio, wt % | 0:09 |

The ISO 8217, Category ISO-F RMG 380 specifications for residual marine fuels are given below in TABLE XVI. As used in this disclosure, achieving or meeting the IMO 2020 specifications per ISO 8217 for a particular fuel oil blend is with respect to the values for the blend characteristics as listed in Table XVI below and as confirmed by the respective test methods and/or references provided in ISO 8217. As understood by those skilled in the art, the other specifications provided in ISO 8217, e.g., RMA, RMB, RMD, RME, and RMK, may sought to be achieved by adjusting the blend compositions.

TABLE XVI

| Characteristics | | Unit | Limit | Category ISO-F RMG 380 | Test Method(s) and References |
|---|---|---|---|---|---|
| Kinematic Viscosity @ 50° C. | | cSt | Max | 380.0 | ISO 3104 |
| Density @ 15° C. | | $kg/m^3$ | Max | 991.0 | ISO 3675 or ISO 12185 |
| CCAI | | | Max | 870 | Calculation |
| Sulfur | | mass % | Max | 0.5 | ISO 8754 or ISO 14596 or ASTM D4294 |
| Flash Point | | ° C. | Min | 60.0 | ISO 2719 |
| Hydrogen Sulfide | | mg/kg | Max | 2.00 | IP 570 |
| Acid Number | | mgKOH/g | Max | 2.5 | ASTM D664 |
| Total Sediment - Aged | | mass % | Max | 0.10 | ISO 10307-2 |
| Carbon Residue - Micro Method | | mass % | Max | 18.00 | ISO 10370 |
| Pour Point | Winter | ° C. | Max | 30 | ISO 3016 |
| (upper) | Summer | ° C. | Max | 30 | |
| Water | | vol % | Max | 0.50 | ISO 3733 |
| Ash | | mass % | Max | 0.100 | ISO 6245 |
| Vanadium | | mg/kg | Max | 350 | IP 501, IP 470 or ISO 14597 |

TABLE XVI-continued

| Characteristics | Unit | Limit | Category ISO-F RMG 380 | Test Method(s) and References |
|---|---|---|---|---|
| Sodium | mg/kg | Max | 100 | IP 501, IP 470 |
| Al + Si | mg/kg | Max | 60 | IP 501, IP 470 or ISO 10478 |
| Used Lubricating Oil (ULO): Ca and Z or Ca and P | mg/kg | Max | Ca > 30 and Z > 15 or CA > 30 and P > 15 | IP 501 or IP470, IP 500 |

In the drawings and specification, several embodiments of low sulfur marine bunker fuel oil compositions, and methods of blending such compositions, to increase initial compatibility and enhance longer term stability have been disclosed, and although specific terms are employed, the terms are used in a descriptive sense only and not for purposes of limitation. Embodiments of compositions and related methods have been described in considerable detail with specific reference to the illustrated embodiments. However, it will be apparent that various modifications and changes to disclosed features can be made within the spirit and scope of the embodiments of compositions and related methods as may be described in the foregoing specification, and features interchanged between disclosed embodiments. Such modifications and changes are to be considered equivalents and part of this disclosure.

What is claimed is:

1. A method of making a low sulfur marine bunker fuel oil composition, the method comprising:

producing a vacuum tower bottoms having a sulfur content of less than about 2 percent by weight;

filtering a decant oil to at least partially remove fluid catalytic cracking catalyst fines to reduce an aluminum and a silicon content and produce a filtered decant oil therefrom;

blending the filtered decant oil into the vacuum tower bottoms, the filtered decant oil having a sulfur content of less than about 1 percent by weight; and blending a vacuum gas oil having a sulfur content of less than about 0.1 percent by weight into the vacuum tower bottoms that is blended with the filtered decant oil to define the low sulfur marine bunker fuel oil composition, the low sulfur marine bunker fuel oil composition having about 12 percent to about 50 percent by volume of the vacuum tower bottoms, at least about 16 percent by volume of filtered decant oil and about 25 percent to about 74 percent by volume of vacuum gas oil, the low sulfur marine fuel oil composition also having a combined volume of the vacuum tower bottoms and the filtered decant oil that is at least about 50 percent, a final sulfur content of less than about 0.5 percent by weight, and an aromatic content of greater than about 50 percent by weight.

2. The method of claim 1, further comprising producing the decant oil in a fluid catalytic cracker that has a hydrotreated hydrocarbon feed thereto.

3. The method of claim 1, wherein the low sulfur marine bunker fuel oil composition has between about 16 percent to about 40 percent by volume of the filtered decant oil.

4. The method of claim 1, wherein the low sulfur marine bunker fuel oil composition has an aromatics content between about 50 percent to about 85 percent.

5. The method of claim 1, wherein the vacuum tower bottoms and the decant oil each have a total aged sediment of greater than about 0.1 percent by weight.

6. The method of claim 5, wherein the low sulfur marine bunker fuel oil composition has a total aged sediment of less than about 0.1 percent by weight.

7. A method of making a low sulfur fuel oil composition as a low sulfur marine bunker fuel oil, the method comprising:

obtaining a residuum having a sulfur content of at least about 1.5 percent by weight, the residuum comprising between about 12 percent to about 50 percent by volume of the low sulfur fuel oil composition;

introducing a catalytic cracked aromatic process oil into a blend tank along with the residuum to define an intermediate blend, the catalytic cracked aromatic process oil being from a fluid catalytic cracker and having a sulfur content of less than about 0.5 percent by weight, the catalytic cracked aromatic process oil also comprising at least about 16 percent by volume of the low sulfur fuel oil composition, the combined concentration of residuum and the catalytic cracked aromatic process oil in the low sulfur fuel oil composition comprising at least about 50 percent by volume; and introducing a low sulfur cutter stock into the intermediate blend in the blend tank to define the low sulfur fuel oil composition, the low sulfur cutter stock selected from the group consisting of a vacuum gas oil, a cycle oil, and a diesel fuel, the low sulfur cutter stock comprising a sulfur content of less than about 0.15 percent by weight and comprising between about 25 percent to about 74 percent by volume of the low sulfur fuel oil composition, the low sulfur fuel oil composition comprising a sulfur content of less than about 0.5 percent by weight, a total aromatics content of at least about 45% by volume, and the combined concentration of residuum and catalytic cracked aromatic process oil of at least about 35% by volume.

8. The method of claim 7, wherein the residuum comprises at least one of atmospheric tower bottoms or vacuum tower bottoms.

9. The method of claim 7, wherein the catalytic cracked aromatic process oil comprises a decant oil that has at least some of an aluminum or a silicon removed therefrom prior to introducing the decant oil into the blend tank.

10. The method of claim 7, wherein the combined concentration of residuum and catalytic cracked aromatic process oil in the low sulfur fuel oil composition comprises at least about 60 percent by volume.

11. The method of claim 7, wherein the combined concentration of residuum and catalytic cracked aromatic process oil in the low sulfur fuel oil composition comprises at least about 70 percent by volume.

12. The method of claim 7, wherein the low sulfur fuel oil composition comprises a sulfur content of less than about 0.45 percent by weight.

13. The method of claim 7, further comprising filtering the catalytic cracked aromatic process oil to remove, at least partially, fluid catalytic cracking catalyst fines therefrom prior to the blending of the catalytic cracked aromatic process oil with the residuum, and blending a heel hydrocarbon fraction with at least one of the residuum, the catalytic cracked aromatic process oil, or the intermediate blend.

14. A method of making a low sulfur marine bunker fuel oil, the method comprising:

producing a vacuum tower residuum in a vacuum distillation column, the vacuum tower residuum having a sulfur content of less than about 2 percent by weight and a total aged sediment of greater than 0.1 percent by weight;

filtering a catalytic cracked aromatic process oil to remove, at least partially, fluid catalytic cracking catalyst fines therefrom;

introducing the catalytic cracked aromatic process oil into a blend tank along with the vacuum tower residuum to define an intermediate blend, the catalytic cracked aromatic process oil comprising at least one of a decant oil or a cycle oil that is produced from a hydrotreated gas oil feed to a fluid catalytic cracker, the catalytic cracked aromatic process oil having a sulfur content of less than about 0.5 percent by weight and a total aged sediment of greater than about 0.1 percent by weight, the intermediate blend having a total aged sediment of less than about 0.1 percent by weight, the catalytic cracked aromatic process oil contributing less than about 60 weight percent of cracked stock to the low sulfur marine bunker fuel oil;

blending an added low sulfur cutter stock with the intermediate blend in the blend tank to define the low sulfur fuel oil composition, the low sulfur cutter stock comprising one or more of a vacuum gas oil or a diesel fuel, the low sulfur cutter stock having a sulfur content of less than about 0.5 percent by weight; and providing the low sulfur fuel oil composition as the low sulfur marine bunker fuel oil, the vacuum tower residuum comprising between about 12 percent to about 50 percent by weight of the low sulfur marine bunker fuel oil, the catalytic cracked aromatic process oil comprising at least about 16 percent by volume of the low sulfur marine bunker fuel oil, and the low sulfur cutter stock comprising between about 25 percent to about 74 percent by volume of the low sulfur marine bunker fuel oil, the low sulfur marine bunker fuel oil having a sulfur content of less than about 0.5 percent by weight, a total aromatics content of at least about 45 percent by weight, and a combined concentration of vacuum tower residuum and catalytic cracked aromatic process oil of at least about 35 percent by volume.

15. The method of claim 14, wherein the vacuum tower residuum has a sulfur content of less than about 1.5 percent by weight.

16. The method of claim 14, wherein providing the low sulfur fuel oil composition as the low sulfur marine bunker fuel oil occurs without hydrotreating the low sulfur fuel oil composition after blending the low sulfur cutter stock with the intermediate blend.

17. The method of claim 14, wherein the catalytic cracked aromatic process oil comprises a decant oil that has at least some aluminum or silicon removed therefrom prior to introducing the decant oil into the blend tank.

18. The method of claim 14, further comprising blending a heel hydrocarbon fraction with at least one of the residuum, the catalytic cracked aromatic process oil, or the intermediate blend.

19. A low sulfur marine bunker fuel oil composition comprising:

a volume % of between about 25 to about 75 of an intermediate blend of an asphaltenic resid and an aromatic rich hydrocarbon fraction; and a volume % of between about 25 to about 75 of a low sulfur cutter stock.

20. The bunker fuel oil composition of claim 19, wherein the asphaltenic resid and the aromatic rich hydrocarbon fraction intermediate blend comprises an asphaltenes in a weight % greater than about 1, a resins in a weight % of between about 1 to about 25, and an aromatics in a weight % of between about 1 to about 75.

21. The bunker fuel oil composition of claim 19, wherein the aromatic rich hydrocarbon fraction comprises an aromatic content greater than about 50 weight %.

22. The bunker fuel oil composition of claim 19, wherein the low sulfur cutter stock comprises one or more of a vacuum gas oil, a cycle oil, a diesel fuel, a middle distillate, or a substantially paraffinic stock.

23. A low sulfur marine bunker fuel oil composition comprising:

at least about 35% by volume of an asphaltenic residuum blended with an asphaltene stabilizer; and about 24% to about 75% by volume of a low sulfur cutter stock.

24. The bunker fuel oil composition of claim 23, wherein the asphaltene stabilizer comprises one or more of a resin-containing fraction or a highly aromatic fraction.

25. The bunker fuel oil composition of claim 24, wherein the highly aromatic fraction comprises one or more of a decant oil, a cycle oil, a slurry oil, a light cycle oil, or an aromatic stock.

26. The bunker fuel oil composition of claim 24, wherein the aromatic rich hydrocarbon fraction comprises an aromatic content greater than about 50 weight %.

* * * * *